US009234288B2

(12) United States Patent
Powell, IV et al.

(10) Patent No.: US 9,234,288 B2
(45) Date of Patent: Jan. 12, 2016

(54) CONDUCTOR OF HIGH ELECTRICAL CURRENT AT HIGH TEMPERATURE IN OXYGEN AND LIQUID METAL ENVIRONMENT

(75) Inventors: Adam Clayton Powell, IV, Newton, MA (US); Soobhankar Pati, Boston, MA (US); Stephen Joseph Derezinski, Wellesley, MA (US); Garrett Lau, Palmetto Bay, FL (US); Uday B. Pal, Dover, MA (US); Xiaofei Guan, Boston, MA (US); Srikanth Gopalan, Westborough, MA (US)

(73) Assignees: Infinium, Inc., Natick, MA (US); The Trustees of Boston University, Boston, MA (US)

( * ) Notice: Subject to any disclaimer, the term of this patent is extended or adjusted under 35 U.S.C. 154(b) by 133 days.

(21) Appl. No.: 13/600,761

(22) Filed: Aug. 31, 2012

(65) Prior Publication Data

US 2013/0192998 A1 Aug. 1, 2013

Related U.S. Application Data

(60) Provisional application No. 61/530,277, filed on Sep. 1, 2011.

(51) Int. Cl.
*C25B 9/00* (2006.01)
*C25B 11/00* (2006.01)
(Continued)

(52) U.S. Cl.
CPC . *C25C 7/025* (2013.01); *C25C 7/00* (2013.01); *H01R 3/08* (2013.01); *Y10T 29/49117* (2015.01)

(58) Field of Classification Search
CPC ..... C25B 9/00; C25B 11/00; C25B 11/02; G01N 27/404–27/407; G01N 27/409; G01N 27/419; G01N 27/41; F01N 2560/00–2560/20; F01N 2550/00–2550/024; G01M 15/10; G01M 15/102; G01M 15/104
USPC ..... 204/242, 280, 279
See application file for complete search history.

(56) References Cited

U.S. PATENT DOCUMENTS 400,664 A 4/1889 Hall
3,578,580 A 10/1967 Schmidt-Hatting et al.
(Continued)

FOREIGN PATENT DOCUMENTS

WO WO-87/00695 A1 1/1987
WO WO-2007/011669 1/2007
WO WO-2010/126597 11/2010

OTHER PUBLICATIONS

Krishnan, A. et al., "Solid Oxide Membrane Process for Magnesium Production directly from Magnesium Oxide," Metall. Mater. Trans. 36B, pp. 463-473, 2005.
(Continued)

*Primary Examiner* — Zulmariam Mendez
(74) *Attorney, Agent, or Firm* — Wilmer Cutler Pickering Hale and Dorr LLP

(57) ABSTRACT

In one aspect, the present invention is directed to apparatuses for and methods of conducting electrical current in an oxygen and liquid metal environment. In another aspect, the invention relates to methods for production of metals from their oxides comprising providing a cathode in electrical contact with a molten electrolyte, providing a liquid metal anode separated from the cathode and the molten electrolyte by a solid oxygen ion conducting membrane, providing a current collector at the anode, and establishing a potential between the cathode and the anode.

23 Claims, 28 Drawing Sheets

(51) Int. Cl.

| | |
|---|---|
| ***C25B 11/02*** | (2006.01) |
| ***C25C 7/02*** | (2006.01) |
| ***C25C 7/00*** | (2006.01) |
| ***H01R 3/08*** | (2006.01) |

(56) References Cited

U.S. PATENT DOCUMENTS

| | | | | |
|---|---|---|---|---|
| 3,867,274 | A | 2/1975 | Herman | |
| 4,173,518 | A | 11/1979 | Yamada et al. | |
| 4,397,729 | A | 8/1983 | Duruz et al. | |
| 4,443,314 | A | 4/1984 | Secrist et al. | |
| 4,664,760 | A | 5/1987 | Jarrett | |
| 5,006,209 | A | 4/1991 | Beck et al. | |
| 5,254,232 | A | 10/1993 | Sadoway | |
| 5,290,413 | A | 3/1994 | Bauer et al. | |
| 5,567,286 | A * | 10/1996 | Pal et al. | 204/246 |
| 5,976,345 | A | 11/1999 | Pal et al. | |
| 6,299,742 | B1 | 10/2001 | Pal et al. | |
| 6,379,844 | B1 | 4/2002 | Redey et al. | |
| 6,532,769 | B1 | 3/2003 | Meinhardt et al. | |
| 6,878,246 | B2 * | 4/2005 | Latvaitis et al. | 204/280 |
| 7,678,484 | B2 | 3/2010 | Tao et al. | |
| 2005/0199508 | A1 * | 9/2005 | D'Astolfo et al. | 205/380 |
| 2009/0000955 | A1 | 1/2009 | Pal | |
| 2009/0071841 | A1 | 3/2009 | Pal et al. | |
| 2010/0276281 | A1 | 11/2010 | Sandoval et al. | |

OTHER PUBLICATIONS

Britten, S.C., et al., "Solid-State Amperometric Sensor for the In-Situ Monitoring of Slag Composition and Transport Properties", Metallurtical and Materials Transactions, Aug. 2000, vol. 31B, pp. 733-753.

Krishnan et al., "Solid Oxide Membrane (SOM) technology for environmentally sound production of tantalum metal and alloys from their oxide sources", Scan. J. Metall., 2005, vol. 34, No. 5, pp. 293-301.

Pati, Soobhankar, et al., "Hydrogen Production Using Solid Oxide Membrane Electrolyzer with Solid Carbon Reductant in Liquid Metal Anode", J. Electrochemical Society, 2009, vol. 156, No. 9, pp. B1067-B1077.

Pati, Soobhankar, et al., "A solid oxide membrane electrolyzer for production of hydrogen and syn-gas from steam and hydrocarbon waste in a single step", International Journal of Hydrogen Energy, 2011, vol. 36, pp. 152-159.

Suput, M., et al., "Solid oxide membrane technology for environmentally sound production of titanium", Mineral Processing and Extractive Metallurgy, Jun. 2008, vol. 117, No. 2, pp. 118-122.

Pyo, Seong-Soo, et al., "Characteristic of $(La_{0.8}Sr_{0.2})_{0.98}MnO_3$ coating on Crofer22APU used as metallic interconnects for solid oxide fuel cell", Int. J. Hydrogen Energy, 2011, vol. 36, pp. 1868-1881.

International Search Report and Written Opinion issued for PCT/US2012/053340, dated Nov. 14, 2012, 11 pages.

European Search Report issued on Jun. 16, 2015, in European Application No. 12826855.4, 9 pages.

* cited by examiner

C

D

D

2470

2490

C

CONDUCTOR OF HIGH ELECTRICAL CURRENT AT HIGH TEMPERATURE IN OXYGEN AND LIQUID METAL ENVIRONMENT

CROSS-REFERENCE TO RELATED APPLICATIONS

This application claims the benefit of and priority to U.S. provisional patent application Ser. No. 61/530,277, filed Sep. 1, 2011, entitled "Conductor of High Electrical Current at High Temperature in Oxygen and Liquid Metal Environment", the disclosure of which is hereby incorporated by reference in its entirety for all purposes.

STATEMENT OF GOVERNMENT SUPPORT

This invention was made with government support under Grant 1026639 awarded by the National Science Foundation, and Award No. DE-EE0005547, awarded by the Department of Energy. The government has certain rights in the invention.

All publications, patent applications, patents, and other references mentioned herein are incorporated by reference in their entirety. The patent and scientific literature referred to herein establishes knowledge that is available to those skilled in the art. The issued patents, applications, and other publications that are cited herein are hereby incorporated by reference to the same extent as if each was specifically and individually indicated to be incorporated by reference. In the case of inconsistencies, the present disclosure will prevail.

FIELD OF THE INVENTION

The invention relates to conductors of electrical current in an oxygen and liquid metal environment.

BACKGROUND OF THE INVENTION

Several processes for extraction of metals from their oxides have used molten salt electrolysis on an industrial scale since the invention of the Hall-Héroult cell for aluminum production in 1886 (U.S. Pat. No. 400,664; herein incorporated by reference in its entirety). When the raw material is not water-soluble and the product metal is very reactive, as with aluminum, it is most advantageous to dissolve the raw material in a molten salt electrolyte and perform electrolysis in a high temperature cell.

While the Hall-Héroult achieved a breakthrough in aluminum production, researchers and inventors since then have been trying for decades to improve the anode to produce oxygen instead of $CO_2$ as the anode product. A recent invention called Solid Oxide Membrane (SOM) Electrolysis accomplishes this by adding a solid electrolyte between the molten salt and anode (see, for example, U.S. Pat. Nos. 5,976,345 and 6,299,742; each herein incorporated by reference in its entirety). The process, shown schematically in FIG. 1 for metal production, consists of a metal cathode, a molten salt electrolyte bath which dissolves the metal oxide which is in contact with the cathode, a solid oxygen ion-conducting membrane (SOM) typically consisting of zirconia stabilized by yttria (YSZ) or other oxide-stabilized zirconia (e.g. magnesia- or calcia-stabilized zirconia, MSZ or CSZ) in contact with the molten salt bath, an anode in contact with the solid oxygen ion-conducting membrane, and a means of establishing a potential between the cathode and anode. The metal cations are reduced to metal at the cathode, and oxygen ions migrate through the SOM to the anode, where they are oxidized to produce oxygen gas.

The SOM process has made significant progress toward the production of other metals such as magnesium, tantalum and titanium (See, e.g., U.S. Pat. No. 6,299,742; Britten et al., *Metall. Trans.* 31B:733 (2000); Krishnan et al., *Metall. Mater. Trans.* 36B:463-473 (2005); Krishnan et al., *Scand. J. Metall.*, 34(5):293-301 (2005); and Suput et al., *Mineral Processing and Extractive Metallurgy* 117(2):118-122 (2008); each herein incorporated by reference in its entirety). This process runs at high temperature, typically 1000-1300° C., in order to maintain high ionic conductivity of the SOM. The most promising anode materials for the process are an oxygen-stable liquid metal, such as silver or its alloys with copper or tin (International Patent Application No. PCT/US2006/027255; herein incorporated by reference in its entirety). This leads to the use of a device which can establish a good electrical connection between that anode and the DC current source, known as the anode current collector. The current collector, like the anode itself, must be stable in liquid metal or make good contact with oxygen stable electronic oxides or cermets, and must conduct electricity well from ambient temperature to the high process temperature.

To date, only iridium is known to satisfy these criteria for the current collector in a liquid metal anode. Solid oxide fuel cells (SOFC) use scale-forming oxides, but the higher temperature of SOM electrolysis than SOFC makes it relatively difficult to use the SOFC current collector approaches. Most oxidation-resistant steels and nickel alloys rapidly oxidize at the very high temperature of SOM Electrolysis, and some refractory metals such as platinum dissolve in liquid silver. Oxidation-resistant alloys also generally have significantly lower electrical conductivity than purer metals.

Thus, there remains a need for more efficient and scalable apparatuses and processes to produce oxygen instead of carbon dioxide as the anode product during production of metals from the corresponding metal oxides. There also remains a need for stable and inexpensive anode systems to process metal oxides into pure metals. In particular, there remains a need for apparatuses and methods that conduct current at high temperature in an oxygen generating environment. This invention addresses these needs.

BRIEF SUMMARY OF THE INVENTION

In one aspect of the invention, an apparatus for electrically connecting a liquid metal anode to a current source of an electrolytic cell comprising (a) a tube having a first end and a second end, the tube comprising a material stable in an environment with oxygen partial pressure above 0.1 atm and robust in thermal gradients of at least 10° C./cm; (b) a first electronic conductor disposed at a first end of the tube; and (c) a second electronic conductor for electrically connecting the first electronic conductor to the current source of the electrolytic cell, the second conductor being at least partially disposed within the tube is provided.

In another aspect of the invention, a method for electrically connecting a liquid metal anode to a current source of an electrolytic cell comprising (a) providing a tube having a first end and a second end, the tube comprising a material stable in an environment with oxygen partial pressure above 0.1 atm and robust in thermal gradients of at least 10° C./cm; (b) providing a first electronic conductor disposed at a first end of the tube; and (c) providing a second electronic conductor for electrically connecting the first electronic conductor to the current source of the electrolytic cell, the second conductor being at least partially disposed within the tube is provided.

In yet another aspect of the invention, a method for collecting electrical current in an oxygen rich environment at a liquid metal anode of an electrolytic cell comprising (a) providing a tube having a first end and a second end, the tube comprising a material stable in an environment with oxygen partial pressure above 0.1 atm and robust in thermal gradients of at least 10° C./cm; (b) providing a first electronic conductor disposed at a first end of the tube; and (c) providing a second electronic conductor for electrically connecting the first electronic conductor to a current source of the electrolytic cell, the second conductor being at least partially disposed within the tube is provided.

In some embodiments, the second conductor comprises an upper core and a lower core. In some embodiments, the apparatus further comprises a contact in electronic communication with the first conductor and the second conductor. In some embodiments, the contact has a melting or solidus point below the operating temperature of the electrolytic cell and in a liquid or semi-solid state at the operating temperature of the electrolytic cell, and a resistance below 0.1 ohm.

BRIEF DESCRIPTION OF THE DRAWINGS

The following figures are illustrative only and are not intended to be limiting.

FIG. 22 (B). SEM image of a first cross section of a current collector embodiment of the invention.

FIG. 23 (B). SEM image of a second cross section of a current collector embodiment of the invention at 25× magnification.

FIG. 23 (C). SEM image of a second cross section of a current collector embodiment of the invention at 500× magnification.

FIG. 23 (D). SEM image of a second cross section of a current collector embodiment of the invention at 2000× magnification.

FIG. 24 (B). SEM image of a third cross section of a current collector embodiment of the invention showing an LSM first conductor and silver contact.

FIG. 24 (C). SEM image of a third cross section of a current collector embodiment of the invention at low magnification.

FIG. 24 (D). SEM image of the interface between the LSM first conductor and silver contact, with a line along with composition was measured by energy-dispersive spectroscopy (EDS).

FIG. 24 (E). Concentrations of strontium, silver, lanthanum, and manganese along the line in FIG. 24D, as measured by EDS

DETAILED DESCRIPTION

Described herein are methods and apparatuses useful for conducting current at high temperature in oxygen and liquid metal environment.

Definitions

As used herein and in the appended claims, the singular forms "a," "an," and "the" include plural references unless the content clearly dictates otherwise.

The term "about" is used herein to mean approximately, in the region of, roughly, or around. When the term "about" is used in conjunction with a numerical range, it modifies that range by extending the boundaries above and below the numerical values set forth. The term "about" is used herein to modify a numerical value above and below the stated value by a variance of 20%.

Figure 1:
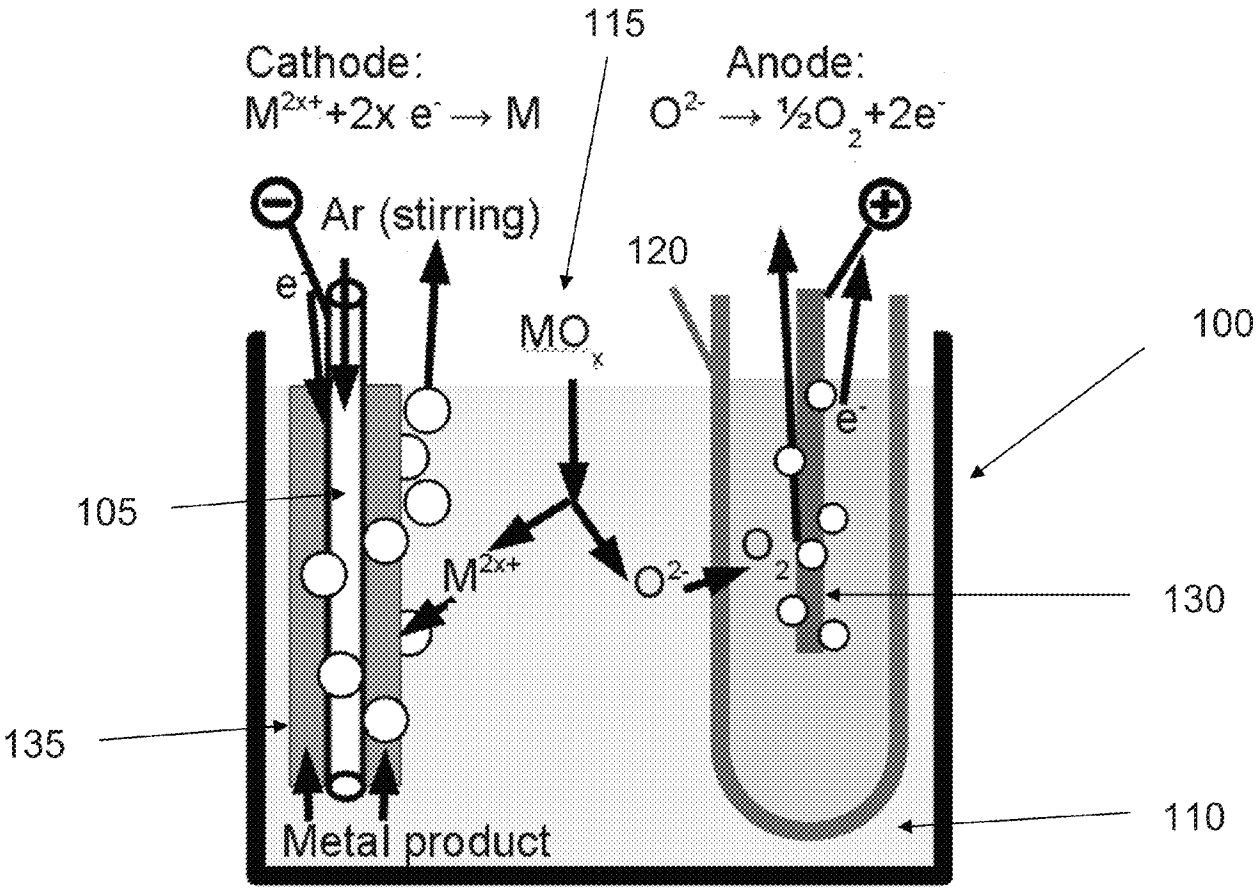
FIG. 1. A schematic illustration of an SOM process for making metal and oxygen from a metal oxide.

Recent development of the solid oxide membrane (SOM) electrolysis process produces oxygen instead of carbon dioxide at the anode (see, for example, U.S. Pat. Nos. 5,976,345, and 6,299,742; each herein incorporated by reference in its entirety). The process as applied to metal production is shown in FIG. 1. The apparatus 100 consists of a metal cathode 105, a molten salt electrolyte bath 110 that dissolves the metal oxide (115) which is in electrical contact with the cathode, a solid oxygen ion conducting membrane (SOM) 120 typically consisting of zirconia stabilized by yttria (YSZ) or other oxide-stabilized zirconia (e.g., magnesia- or calcia-stabilized zirconia, MSZ or CSZ, respectively) in contact with the molten salt bath 110, an anode 130 in contact with the solid oxygen ion-conducting membrane, and a power source for establishing a potential between the cathode and anode. The power source can be any of the power sources suitable for use with SOM electrolysis processes and are known in the art.

The metal cations are reduced to metal (135) at the cathode, and oxygen ions migrate through the membrane to the anode where they are oxidized to produce oxygen gas. The SOM blocks back-reaction between anode and cathode products. It also blocks ion cycling, which is the tendency for subvalent cations to be re-oxidized at the anode, by removing the connection between the anode and the metal ion containing molten salt because the SOM conducts only oxide ions, not electrons (see, U.S. Pat. Nos. 5,976,345, and 6,299,742; each herein incorporated by reference in its entirety); however the process runs at high temperatures, typically 1000-1300° C. in order to maintain high ionic conductivity of the SOM. The anode must have good electrical conductivity at the process temperature while exposed to pure oxygen gas at approximately 1 atm pressures.

A liquid silver anode is shown in U.S. Pat. No. 3,578,580, where oxygen bubbles can be collected by means of a bell dipping into the liquid silver, the bell serving at the same time as a current lead to the anode and consisting for example of a chrome-nickel alloy. However, chrome-nickel alloys oxidize quickly.

One approach to date has been to use either an oxygen-stable liquid metal, such as silver or its alloys with copper, tin, etc., or oxygen stable electronic oxides, oxygen stable cermets, and stabilized zirconia composites with oxygen stable electronic oxides as the anode (PCT/US06/027255; herein incorporated by reference in its entirety). This necessitates the use of a device that can establish a good electrical connection between that anode and the DC current source, known as the anode current collector. The current collector, like the anode, must be sufficiently stable in liquid metal or make good contact with oxygen stable electronic oxides or cermets, and must conduct electricity sufficiently from ambient temperature to the high process temperature.

Figure 2:
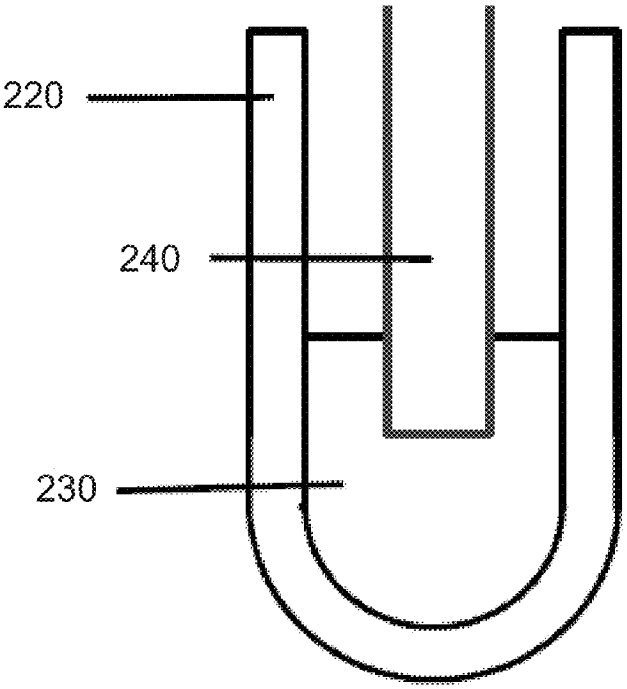
FIG. 2. An illustrative embodiment of an oxygen stable electronic inert current collector in liquid metal anode.

Iridium is known to satisfy these criteria for the current collector (240) in a liquid metal anode (230), as shown for the SOM tube (220) in FIG. 2 (PCT/US06/027255; herein incorporated by reference in its entirety). Solid oxide fuel cells (SOFC) use scale-forming oxides, but the higher temperature of SOM electrolysis than SOFC will make it relatively difficult to use the SOFC current collector approaches. Most oxidation-resistant steels and nickel alloys rapidly oxidize at the very high temperature of SOM electrolysis, and some refractory metals such as platinum dissolve in liquid silver. Oxidation-resistant alloys also generally have significantly lower electrical conductivity than purer metals.

Some embodiments of the invention involve the use of liquid anodes with the materials and configurations of current collector apparatuses. The current collector apparatuses comprise, in some embodiments, two to six components. The apparatuses comprise a first conductor, a second conductor, a tube, a contact, and/or a seal. In some embodiments, the first conductor comprises a cap. In some embodiments, the second conductor comprises an upper core and a lower core. The upper core are connected by, for example, a press fit, solid state diffusion bond or friction weld. Other connecting methods can also be used. In some embodiments, the tube comprises a sheath.

Figure 3:
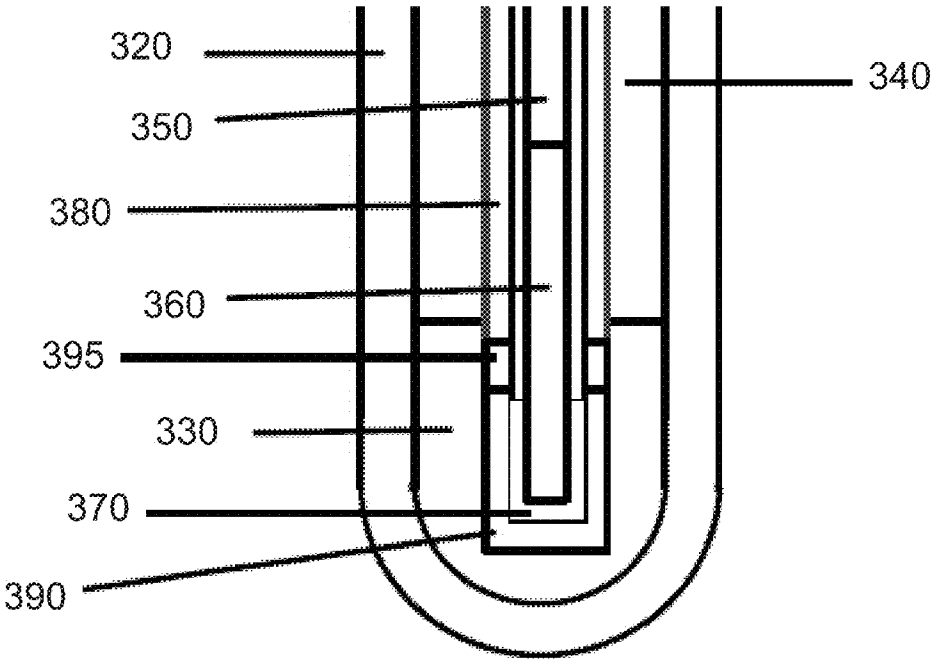
FIG. 3. A schematic illustration of a current collector/anode/SOM configuration of the invention.

FIG. 3 shows an embodiment of a current collector/anode/SOM configuration of the invention. FIG. 3 shows a liquid anode (330) for use with embodiments of the present invention. The anode (330) is in ion-conducting contact with the solid oxygen ion-conducting membrane (320), and with the current collector (340).

In this embodiment, components of the current collector (340) include an upper core (350), a lower core (360), a contact (370), a tube (380) and a first conductor (390). The tube and the first conductor separate the upper and lower cores and the contact from high-temperature oxygen gas produced at the anode in order to protect the core components from oxidation. In some embodiments, the tube and the first conductor also separate the upper and lower cores and the contact from lower-temperature oxygen gas produced at the anode.

The upper core advantageously has high electrical conductivity. In some embodiments, the high electrical conductivity comprises high electronic conductivity.

The lower core advantageously has high electrical conductivity, in addition to a melting point above the electrolysis cell operating temperature (ECOT), and low solubility in the contact material. In some embodiments, the high electrical conductivity comprises high electronic conductivity. In some embodiments, the lower core has high electrical conductivity, in addition to a melting point above the electrolysis cell operating temperature (ECOT). In some embodiments, the lower core has high electrical conductivity, in addition to a melting point above the electrolysis cell operating temperature (ECOT), and low solubility in the contact material. In some embodiments, the lower core is coated with a metal that has a melting point above the electrolysis cell operating temperature (ECOT), and low solubility in the contact material.

In some embodiments, high conductivity for metals is conductivity at or above about 10,000 s/cm. For example, liquid silver has conductivity about 60,000 S/cm and solid copper has conductivity around 110,000 S/cm at its melting point. In some embodiments, high conductivity for metals is conductivity at or above about 20,000 S/cm. In some embodiments, high conductivity for metals is conductivity at or above about 30,000 S/cm. In some embodiments, high conductivity for metals is conductivity at or above about 40,000 S/cm. In some embodiments, high conductivity for metals is conductivity at or above about 50,000 S/cm. In some embodiments, high conductivity for metals is conductivity at or above about 60,000 S/cm. In some embodiments, high conductivity for metals is conductivity at or above about 80,000 S/cm. In some embodiments, high conductivity for metals is conductivity at or above about 100,000 S/cm. In some embodiments, high conductivity for metals is conductivity at or above about 110,000 S/cm.

For conducting oxides, for example, strontium-doped lanthanum manganite (LSM), high conductivity is conductivity at or above about 10 S/cm. For conducting oxides, for example, zirconia, high conductivity is conductivity at or above about 0.1-0.15 S/cm at 1150° C. In some embodiments, conducting oxides are at least as conductive as zirconia. Thus, conductivity for conducting oxides may be greater than about 0.1 S/cm.

Low solubility generally is less than 1% by weight. Thus, in some embodiments, a component with low solubility dissolves less than about 1% by weight. In some embodiments, a component with low solubility dissolves less than about 0.5% by weight. In some embodiments, a component with low solubility dissolves less than about 0.2% by weight. In some embodiments, LSM dissolves less than about 1% by weight in silver. In some embodiments, LSM dissolves less than about 0.5% by weight in silver. In some embodiments, LSM dissolves less than about 0.2% by weight in silver.

In some embodiments, penetration of the liquid anode material greater than about 100 microns into the LSM surface does not occur.

The contact advantageously has a solidus point below the ECOT, and good electrical conductivity (at least about 0.1 S/cm) in the liquid or semi-solid state at the ECOT. In some embodiments, the contact is in electronic communication with the first conductor and the second conductor. In some embodiments, good electrical conductivity is at least about 0.1 S/cm in the liquid or semi-solid state at the ECOT. In some embodiments, good electrical conductivity is at least about 0.5 S/cm in the liquid or semi-solid state at the ECOT. In some embodiments, good electrical conductivity is at least about 1.0 S/cm in the liquid or semi-solid state at the ECOT.

The seal (395) advantageously has a liquidus point and/or glass transition above the ECOT, has minimal solubility in the liquid metal anode, is structurally stable in the liquid metal anode saturated with oxygen, has low oxygen diffusivity, and has the ability to provide a hermetic seal between two solids at ECOT, optionally by creep and/or glass flow and/or sintering and/or surface tension or some combination of these, but with sufficient viscosity or low enough creep rate so as to not flow out of the first conductor-tube gap. In some embodiments, the seal has low solubility and maintains its structural integrity in the liquid metal anode supersaturated with oxygen at the ECOT.

The tube advantageously is structurally stable in oxygen at ECOT and between ECOT and ambient temperature, has low thermal conductivity, and has resistance to failure due to temperature gradients or thermal or mechanical shock, which would allow oxygen breach. In some embodiments, the tube is stable in pure oxygen at ECOT. Structural stability includes, for example, resistance to cracking, corrosion, melting, unstably sintering or changing in a way such as to fail to prevent oxygen breach.

The first conductor advantageously has low solubility in the liquid metal anode supersaturated with oxygen at ECOT, is stable in oxygen, has high electrical conductivity, has low oxygen diffusivity and low oxide ion conductivity. In some embodiments, the first conductor is stable in pure oxygen at ECOT. In some embodiments, the high electrical conductivity comprises high electronic conductivity.

It will be noted that two or more components of the current collector may be comprised of substantially the same material. For example, as noted herein, iridium can satisfy many of the above properties for current collector components, as do certain oxides with electronic conductivity, such as strontium-doped lanthanum manganite (LSM), and can serve in all of the roles shown in FIG. 3. However, such materials are very expensive, and their electrical conductivities are not as high as those of many other materials, so it is best to limit their role in the current collector to the components with very demanding physical, chemical, and electrical property requirements.

The fabrication can occur via a variety of methods. In some embodiments, the first conductor is coated onto the lower core via vapor deposition, such as sputtering or spray coating (Pyo et al., *Int. J. Hydrogen Energy* 36:1868-1881 (2011); herein incorporated by reference in its entirety). In such an embodiment, the contact component is not necessary. Thus, in some embodiments, the current collector comprises an upper core, a lower core, a contact, a seal, a tube and a first conductor. In some embodiments, the current collector comprises an upper core and a tube. In some embodiments, the current collector further comprises a lower core. In some embodiments, the current collector further comprises a contact. In some embodiments, the current collector further comprises a seal. In some embodiments, the current collector further comprises a first conductor.

In some embodiments, the upper core comprises a metal or metal oxide. Illustrative upper cores exhibit high electrical conductivity and low cost. Exemplary embodiments for the upper core include copper, nickel, cobalt, iron, chromium, manganese, molybdenum, tungsten, niobium, iridium, and alloys thereof.

Thus, in some embodiments, the upper core is comprised of copper, nickel, cobalt, iron, chromium, manganese, molybdenum, tungsten, niobium, iridium, or alloys thereof.

In some embodiments, the upper core is comprised of copper, nickel, cobalt, iron, chromium, manganese, molybdenum, tungsten, niobium, iridium, or alloys thereof. In some embodiments, the upper core is comprised of copper, nickel, cobalt, iron, chromium, manganese, molybdenum, tungsten, niobium, or iridium. In some embodiments, the upper core is comprised of copper, nickel, cobalt, iron, chromium, manganese, molybdenum, tungsten, or niobium. In some embodiments, the upper core is comprised of copper, nickel, cobalt, iron, chromium, manganese, molybdenum, or tungsten. In some embodiments, the upper core is comprised of copper, nickel, cobalt, iron, chromium, manganese, or molybdenum. In some embodiments, the upper core is comprised of copper, nickel, cobalt, iron, chromium, or manganese. In some embodiments, the upper core is comprised of copper, nickel, cobalt, iron, or chromium. In some embodiments, the upper core is comprised of copper, nickel, cobalt, or iron. In some embodiments, the upper core is comprised of copper, nickel, or cobalt. In some embodiments, the upper core is comprised of copper or nickel. In some embodiments, the upper core is comprised of copper. In some embodiments, the upper core is comprised of nickel.

In some embodiments, the upper core is comprised of alloys of copper, nickel, cobalt, iron, chromium, manganese, molybdenum, tungsten, niobium, or iridium. In some embodiments, the upper core is comprised of alloys of copper, nickel, cobalt, iron, chromium, manganese, molybdenum, tungsten, or niobium. In some embodiments, the upper core is comprised of alloys of copper, nickel, cobalt, iron, chromium, manganese, molybdenum, or tungsten. In some embodiments, the upper core is comprised of alloys of copper, nickel, cobalt, iron, chromium, manganese, or molybdenum. In some embodiments, the upper core is comprised of alloys of copper, nickel, cobalt, iron, chromium, or manganese. In some embodiments, the upper core is comprised of alloys of copper, nickel, cobalt, iron, or chromium. In some embodiments, the upper core is comprised of alloys of copper, nickel, cobalt, or iron. In some embodiments, the upper core is comprised of alloys of copper, nickel, or cobalt. In some embodiments, the upper core is comprised of alloys of copper, or nickel. In some embodiments, the upper core is comprised of alloys of copper. In some embodiments, the upper core is comprised of alloys of nickel.

Exemplary embodiments for the lower core include nickel, cobalt, iron, chromium, manganese, molybdenum, tungsten, niobium, iridium, and alloys thereof. Other exemplary embodiments include materials coated with nickel, cobalt, iron, chromium, manganese, molybdenum, tungsten, niobium, iridium, and alloys thereof.

Thus, in some embodiments, the lower core is comprised of nickel, cobalt, iron, chromium, manganese, molybdenum, tungsten, niobium, iridium, or alloys thereof; or materials coated with nickel, cobalt, iron, chromium, manganese, molybdenum, tungsten, niobium, iridium, or alloys thereof.

In some embodiments, the lower core is comprised of nickel, cobalt, iron, chromium, manganese, molybdenum, tungsten, niobium, iridium, or alloys thereof. In some embodiments, the lower core is comprised of nickel, cobalt, iron, chromium, manganese, molybdenum, tungsten, niobium, or iridium. In some embodiments, the lower core is comprised of alloys of nickel, cobalt, iron, chromium, manganese, molybdenum, tungsten, niobium, or iridium. In some embodiments, the lower core is comprised of nickel, cobalt, iron, chromium, manganese, molybdenum, tungsten, or niobium. In some embodiments, the lower core is comprised of alloys of nickel, cobalt, iron, chromium, manganese, molybdenum, tungsten, or niobium. In some embodiments, the lower core is comprised of nickel, cobalt, iron, chromium, manganese, molybdenum, or tungsten. In some embodiments, the lower core is comprised of alloys of nickel, cobalt, iron, chromium, manganese, molybdenum, or tungsten. In some embodiments, the lower core is comprised of nickel, cobalt, iron, chromium, manganese, or molybdenum. In some embodiments, the lower core is comprised of alloys of nickel, cobalt, iron, chromium, manganese, or molybdenum. In some embodiments, the lower core is comprised of nickel, cobalt, iron, chromium, or manganese. In some embodiments, the lower core is comprised of alloys of nickel, cobalt, iron, chromium, or manganese. In some embodiments, the lower core is comprised of nickel, cobalt, iron, or chromium. In some embodiments, the lower core is comprised of alloys of nickel, cobalt, iron, or chromium. In some embodiments, the lower core is comprised of nickel, cobalt, or iron. In some embodiments, the lower core is comprised of alloys of nickel, cobalt, or iron. In some embodiments, the lower core is comprised of nickel, or cobalt. In some embodiments, the lower core is comprised of alloys of nickel, or cobalt. In some embodiments, the lower core is comprised of nickel. In some embodiments, the lower core is comprised of alloys of nickel.

In some embodiments, the lower core is comprised of materials coated with nickel, cobalt, iron, chromium, manganese, molybdenum, tungsten, niobium, iridium, or alloys thereof. In some embodiments, the lower core is comprised of materials coated with nickel, cobalt, iron, chromium, manganese, molybdenum, tungsten, niobium, or iridium. In some embodiments, the lower core is comprised of materials coated with alloys of nickel, cobalt, iron, chromium, manganese, molybdenum, tungsten, niobium, or iridium. In some embodiments, the lower core is comprised of materials coated with nickel, cobalt, iron, chromium, manganese, molybdenum, tungsten, or niobium. In some embodiments, the lower core is comprised of materials coated with alloys of nickel, cobalt, iron, chromium, manganese, molybdenum, tungsten, or niobium. In some embodiments, the lower core is comprised of materials coated with nickel, cobalt, iron, chromium, manganese, molybdenum, or tungsten. In some embodiments, the lower core is comprised of materials coated with alloys of nickel, cobalt, iron, chromium, manganese, molybdenum, or tungsten. In some embodiments, the lower core is comprised of materials coated with nickel, cobalt, iron, chromium, manganese, molybdenum, or tungsten. In some embodiments, the lower core is comprised of materials coated with alloys of nickel, cobalt, iron, chromium, manganese, molybdenum, or tungsten. In some embodiments, the lower core is comprised of materials coated with nickel, cobalt, iron, chromium, manganese, molybdenum, or tungsten. In some embodiments, the lower core is comprised of materials coated with alloys of nickel, cobalt, iron, chromium, manganese, molybdenum, or tungsten. In some embodiments, the lower core is comprised of materials coated with nickel, cobalt, iron, chromium, manganese, or molybdenum. In some embodiments, the lower core is comprised of materials coated with alloys of nickel, cobalt, iron, chromium, manganese, or molybdenum. In some embodiments, the lower core is comprised of materials coated with nickel, cobalt, iron, chromium, or manganese. In some embodiments, the lower core is comprised of materials coated with alloys of nickel, cobalt, iron, chromium, or manganese. In some embodiments, the lower core is comprised of materials coated with nickel, cobalt, iron, or chromium. In some embodiments, the lower core is comprised of materials coated with alloys of nickel, cobalt, iron, or chromium. In some embodiments, the lower core is comprised of materials coated with nickel, cobalt, or iron. In some embodiments, the lower core is comprised of materials coated with alloys of nickel, cobalt, or iron. In some embodiments, the lower core is comprised of materials coated with nickel, or cobalt. In some embodiments, the lower core is comprised of materials coated with alloys of nickel, or cobalt. In some embodiments, the lower core is comprised of materials coated with nickel. In some embodiments, the lower core is comprised of materials coated with alloys of nickel.

In some embodiments, the lower core is comprised of copper coated with nickel, cobalt, iron, chromium, manganese, molybdenum, tungsten, niobium, iridium, or alloys thereof, wherein the ECOT is lower than the melting point of copper. In some embodiments, the lower core is comprised of copper coated with nickel, cobalt, iron, chromium, manganese, molybdenum, tungsten, niobium, iridium, or alloys thereof, wherein the ECOT is lower than the melting point of copper. In some embodiments, the lower core is comprised of copper coated with nickel, cobalt, iron, chromium, manganese, molybdenum, tungsten, niobium, or iridium, wherein the ECOT is lower than the melting point of copper. In some embodiments, the lower core is comprised of copper coated with alloys of nickel, cobalt, iron, chromium, manganese, molybdenum, tungsten, niobium, or iridium, wherein the ECOT is lower than the melting point of copper. In some embodiments, the lower core is comprised of copper coated with nickel, cobalt, iron, chromium, manganese, molybdenum, tungsten, or niobium, wherein the ECOT is lower than the melting point of copper. In some embodiments, the lower core is comprised of copper coated with alloys of nickel, cobalt, iron, chromium, manganese, molybdenum, tungsten, or niobium, wherein the ECOT is lower than the melting point of copper. In some embodiments, the lower core is comprised of copper coated with nickel, cobalt, iron, chromium, manganese, molybdenum, or tungsten, wherein the ECOT is lower than the melting point of copper. In some embodiments, the lower core is comprised of copper coated with alloys of nickel, cobalt, iron, chromium, manganese, molybdenum, or tungsten, wherein the ECOT is lower than the melting point of copper. In some embodiments, the lower core is comprised of copper coated with nickel, cobalt, iron, chromium, manganese, molybdenum, or tungsten, wherein the ECOT is lower than the melting point of copper. In some embodiments, the lower core is comprised of copper coated with alloys of nickel, cobalt, iron, chromium, manganese, molybdenum, or tungsten, wherein the ECOT is lower than the melting point of copper. In some embodiments, the lower core is comprised of copper coated with nickel, cobalt, iron, chromium, manganese, or molybdenum, wherein the ECOT is lower than the melting point of copper. In some embodiments, the lower core is comprised of copper coated with alloys of nickel, cobalt, iron, chromium, manganese, or molybdenum, wherein the ECOT is lower than the melting point of copper. In some embodiments, the lower core is comprised of copper coated with nickel, cobalt, iron, chromium, or manganese, wherein the ECOT is lower than the melting point of copper. In some embodiments, the lower core is comprised of copper coated with alloys of nickel, cobalt, iron, chromium, or manganese, wherein the ECOT is lower than the melting point of copper. In some embodiments, the lower core is comprised of copper coated with nickel, cobalt, iron, or chromium, wherein the ECOT is lower than the melting point of copper. In some embodiments, the lower core is comprised of copper coated with alloys of nickel, cobalt, iron, or chromium, wherein the ECOT is lower than the melting point of copper. In some embodiments, the lower core is comprised of copper coated with nickel, cobalt, or iron, wherein the ECOT is lower than the melting point of copper. In some embodiments, the lower core is comprised of copper coated with alloys of nickel, cobalt, or iron, wherein the ECOT is lower than the melting point of copper. In some embodiments, the lower core is comprised of copper coated with nickel or cobalt, wherein the ECOT is lower than the melting point of copper. In some embodiments, the lower core is comprised of copper coated with alloys of nickel or cobalt, wherein the ECOT is lower than the melting point of copper. In some embodiments, the lower core is comprised of copper coated with nickel, wherein the ECOT is lower than the melting point of copper. In some embodiments, the lower core is comprised of copper coated with alloys of nickel, wherein the ECOT is lower than the melting point of copper. In some embodiments, the lower core is comprised of nickel coated with niobium.

Exemplary contacts include silver, copper, tin, bismuth, lead, antimony, zinc, gallium, indium, cadmium, aluminum, magnesium, or alloys comprised of these metals. In some embodiments, the contact comprises any one of silver, copper, tin, bismuth, lead, antimony, zinc, gallium, indium, cadmium, aluminum, magnesium or alloys thereof. In some embodiments, the contact comprises any one of silver, copper, tin, bismuth, lead, antimony, zinc, gallium, indium, cadmium or alloys thereof. In some embodiments, the contact comprises any one of silver, copper, tin, bismuth, lead, antimony, zinc, gallium, indium, or cadmium. In some embodiments, the contact comprises silver. In some embodiments, the contact comprises copper. In some embodiments, the contact comprises tin. In some embodiments, the contact comprises bismuth. In some embodiments, the contact comprises alloys of any one of silver, copper, tin, or bismuth. In some embodiments, the contact comprises alloys of silver. In some embodiments, the contact comprises alloys of copper. In some embodiments, the contact comprises alloys of tin. In some embodiments, the contact comprises alloys of bismuth. In some embodiments, the ECOT is not above the melting point of copper.

In some embodiments, alloys for the contact are comprised of greater than about 60% by weight of said metal. In some embodiments, the alloys are comprised of greater than about 70% by weight of said metal. In some embodiments, the alloys are comprised of greater than about 80% by weight of said metal. In some embodiments, the alloys are comprised of greater than about 90% by weight of said metal. In some embodiments, the alloys are comprised of greater than about 95% by weight of said metal.

Exemplary combinations of lower core and contact materials with low solubility in each other include nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, and iridium-copper. Thus, in some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, niobium-bismuth, iridium-silver, or iridium-copper.

In some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, tungsten-copper, niobium-silver, niobium-copper, or niobium-bismuth.

In some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, molybdenum-bismuth, tungsten-silver, or tungsten-copper.

In some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, manganese-silver, molybdenum-silver, molybdenum-copper, molybdenum-tin, or molybdenum-bismuth.

In some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, chromium-bismuth, or manganese-silver.

In some embodiments, the lower core and contact material combination comprises nickel-silver, nickel-bismuth, cobalt-silver, cobalt-copper, cobalt-bismuth, iron-silver, iron-copper, iron-bismuth, chromium-silver, chromium-copper, chromium-tin, or chromium-bismuth.

In some embodiments, the lower core and contact material combination comprises nickel-silver, nickel-bismuth, cobalt-silver, cobalt-copper, cobalt-bismuth, iron-silver, iron-copper, or iron-bismuth.

In some embodiments, the lower core and contact material combination comprises nickel-silver, nickel-bismuth, cobalt-silver, cobalt-copper, or cobalt-bismuth.

In some embodiments, the lower core and contact material combination comprises nickel-silver, or nickel-bismuth.

Figure 13:
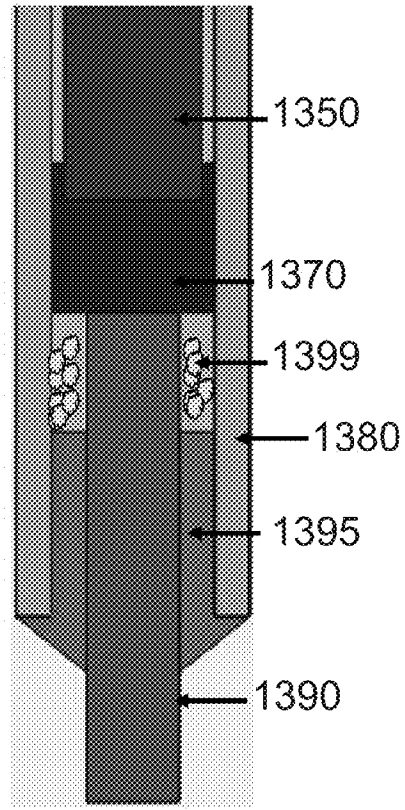
FIG. 13. Another illustrative embodiment of a current collector configuration of the invention.

In an exemplary embodiment (as shown in FIG. 13 and described below), powder such as LSM, LCM, alumina, glass or another material is added above the seal in the gap between the sleeve and the first conductor to prevent oxygen diffusion and/or penetration of the contact. Exemplary materials for seals include glasses that soften around about 1200° C. to about 1300° C., powders that soften and/or sinter at or above about 1200° C., or mixtures thereof. In some embodiments, the powder materials comprise ceramics or metals. In some embodiments, the mixtures comprise alumina, zirconia, magnesia or other oxides. In some embodiments, another material is disposed between the seal and the contact. In some embodiments, another material is lanthanum strontium manganite (LSM) or another material suitable for the first conductor, wherein the first conductor comprises an A-site deficient acceptor-doped lanthanum ferrite or lanthanum cobaltite, wherein A includes dopants selected from Ca, Ce, Pr, Nd, and Gd in the La site; and Ni, Cr, Mg, Al, and Mn in the Fe or Co site.

Exemplary materials for the tube include materials which are stable in pure oxygen and robust in thermal gradients due to a high value of the following quantity: fracture stress times thermal conductivity divided by (modulus times coefficient of thermal expansion). In some embodiments, the tube comprises alumina, mullite, quartz glass, fused silica or combinations thereof, or materials comprised of at least 50% by weight of those materials. In some embodiments, the tube comprises alumina, mullite, quartz glass, or fused silica. In some embodiments, the tube comprises alumina, mullite, quartz glass, fused silica or combinations thereof. In some embodiments, the tube comprises at least 50% by weight of alumina, mullite, quartz glass, fused silica or combinations thereof. In some embodiments, the tube comprises at least 50% by weight of alumina, mullite, quartz glass, or fused silica.

Exemplary first conductor materials comprise A-site deficient acceptor-doped lanthanum ferrite and lanthanum cobaltite ($La_{(1-x)}A_xFeO_3$ or $La_{(1-x)}A_xCoO_3$), where A may include dopants such as Ca, Ce, Pr, Nd or Gd in the La site, and Ni, Cr, Mg, Al or Mn in the Fe or Co site. Other exemplary first conductor materials comprise P-type oxides with high electronic conductivity and low ionic conductivity. Specific embodiments of first conductor materials include Sr-doped $LaMnO_3$ (LSM), (La, Sr)(Co, Fe)$O_3$ (LSCF), Sr-doped $LaCoO_3$ (LSC), Sr-doped $LaFeO_3$ (LSF), Sr-doped $LaVO_3$ (LSV), Sr-doped $La_2NiO_4$ (LSN), Sr-doped $PrMnO_3$ (PSM), Ca-doped $LaMnO_3$ (LCM), Ca-doped $YMnO_3$ (YCM), (Gd, Sr)(Co, Mn)$O_3$ (GSCM), (Gd, Ca)(Co, Mn)$O_3$ (GCCM), (La, Sr)(Cr, Mn)$O_3$ (LSCM), or M-doped $LaNiO_3$ (M=Al, Cr, Mn, Fe, Co, Ga).

In some embodiments, the first conductor comprises iridium or dense electronically-conducting oxides. In some embodiments, the first conductor comprises iridium or strontium-doped lanthanum manganite (LSM). In some embodiments, the first conductor comprises iridium. In some embodiments, the first conductor comprises LSM. In some embodiments, the first conductor comprises yttrium ferrites, manganites, cobaltites or chromites with similar dopants. In some embodiments, the first conductor comprises a cap.

In some embodiments, the current collector is Inconel 601 alloy or Haynes 214/230 alloy.

In some embodiments, an additional function of the tube, and optionally the current collector as a whole, is to displace the liquid anode. In some embodiments, the current collector displaces more than about 50% of the volume inside the SOM but below the plane formed by the top of the anode-SOM contact, or preferably more than about 70% of that volume. This reduces the cost of anode material by greater than about 50-70%, which is particularly important for anodes made of expensive material such as, for example, silver.

In some embodiments, the current collector comprises a component disposed between the tube and the core as an oxygen getter. The oxygen getter serves to protect the core without damaging the core, contact, first conductor or the tube. In some embodiments, the oxygen getter is a sleeve encompassing at least a part of the lower core. In some embodiments, the oxygen getter comprises chips in a closed system. In some embodiments, the oxygen getter comprises any element or mixture of elements with lower electronegativity than all of the internal metals (upper and lower core, contact) and higher electronegativity than all of the oxides (tube, seal, first conductor). In some embodiments, the oxygen getter comprises aluminum, manganese or titanium. In some embodiments, the oxygen getter comprises aluminum. In some embodiments, the oxygen getter comprises manganese. In some embodiments, the oxygen getter comprises titanium.

There is considerable geometric flexibility in the size and placement of these components so long as the configuration is capable of conducting current and the tube is stable in an oxygen rich environment. Exemplary embodiments in configuration are shown herein, but are not intended to be limiting. In one exemplary embodiment, FIG. 3 shows the first conductor (390) enclosing much of the lower core of the second conductor (360) and contact (370), which is beneficial because high first conductor surface area leads to low first conductor resistance. For reasons of material and fabrication costs and mechanical robustness however, it can be beneficial to extend the tube (380) down past the end of the lower core of the second conductor (360), leaving a small first conductor (390) connection at the bottom of the current collector (340). A seal (395) is also positioned between the tube (380) and the first conductor (390). The upper core (350) is disposed above the lower core (360), and the current collector (340) is disposed in the SOM (320), which also contains a liquid anode (330).

Figure 4:
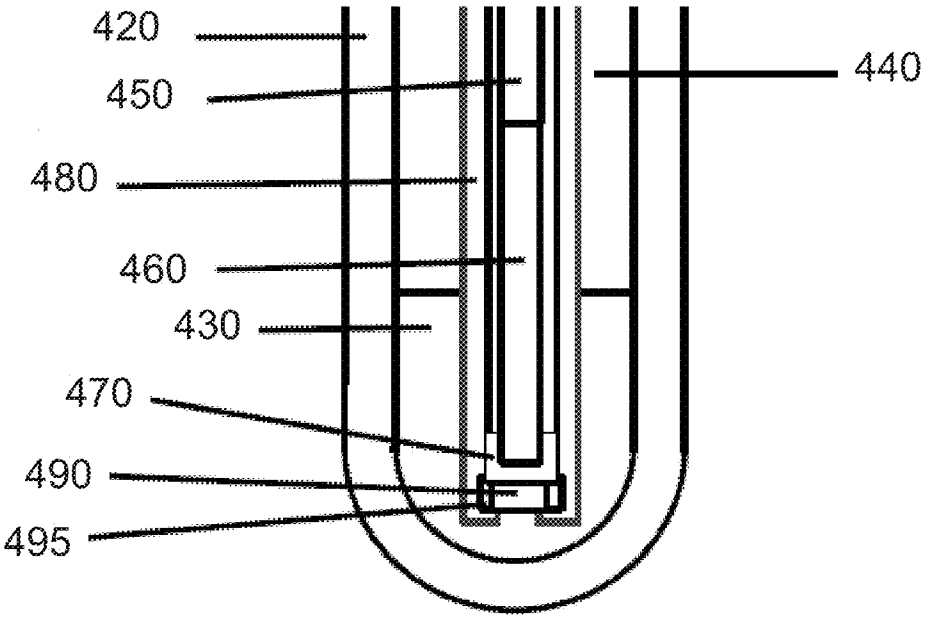
FIG. 4. An illustrative embodiment of a current collector configuration of the invention in which the first conductor is mechanically constrained.
Figure 5:
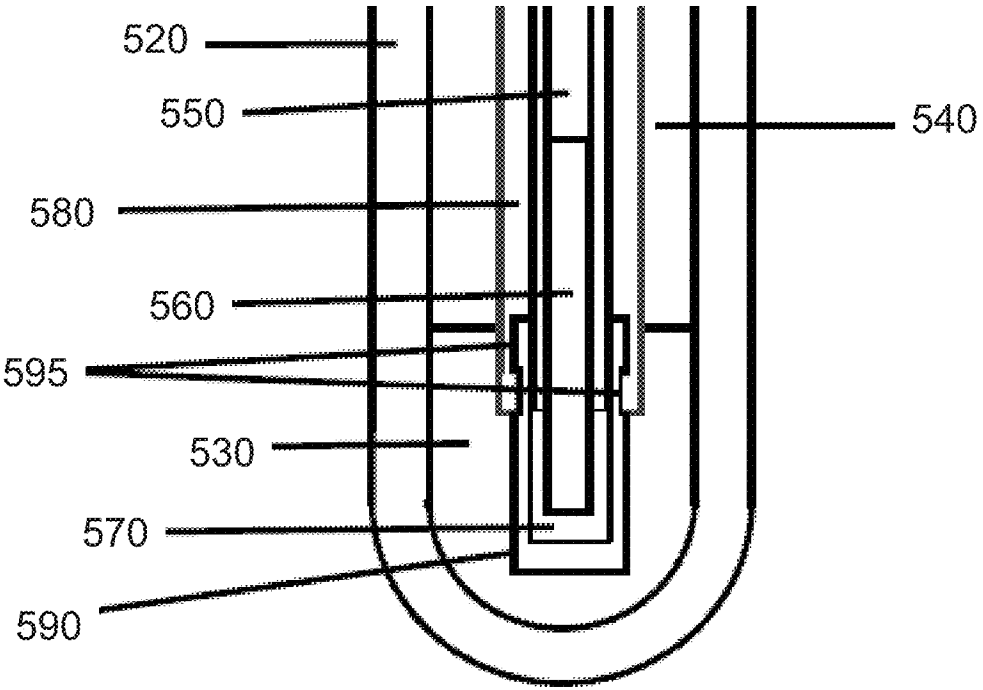
FIG. 5. Another illustrative embodiment of a current collector configuration of the invention in which the first conductor is mechanically constrained.

At ECOT, fastening the first conductor to the tube with an adequate seal can be very difficult, because most seal materials are relatively soft in order to prevent oxygen and liquid anode leakage, so the seal does not provide structural support. FIGS. 4 and 5 show embodiments of SOM (420, 520) containing a liquid anode (430, 530), and the current collector (440, 540). The embodiments of current collector (440, 540) shown in FIGS. 4 and 5 solve this problem by creating a notch in the tube (480, 580) to mechanically fix the seal (495, 595) and first conductor (490, 590) in place. There are several ways to form such a structure, for example by inserting the first conductor (490, 590) and then inserting a ring made of tube material (480, 580) into the tube and bonding it to the tube by methods known to those skilled in the art. Exemplary methods comprise adhesives such as ceramic adhesives, which are pastes comprising ceramic powder (alumina, zirconia, or mullite, or the same material as the tube) mixed with water, oils, organic binders including polymers, or other liquids. FIGS. 4 and 5 also show an upper core (450, 550), lower core (460, 560), and contact (470, 570).

Figure 6:
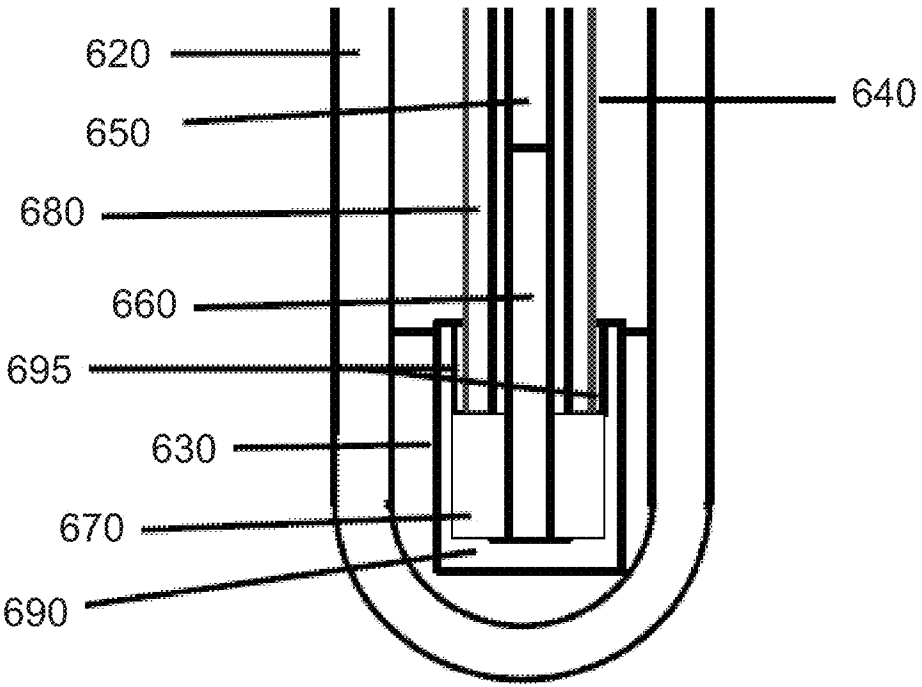
FIG. 6. Yet another illustrative embodiment of a current collector configuration of the invention in which the first conductor is mechanically constrained.

In FIG. 6, another embodiment is shown for the current collector (640) in a SOM (620) containing the liquid anode (630). In this embodiment, the current collector (640) has a upper core (650), a lower core (660), and a contact (670). The seal (695) is disposed between the tube (680) and the first conductor (690). In FIG. 6, the lower core (660) holds the first conductor (690) down against the hydrostatic pressure formed by the liquid metal anode (630) around it, fixing the first conductor in place. FIGS. 4-6 represent three of several potential useful geometries for this joint.

Figure 7:
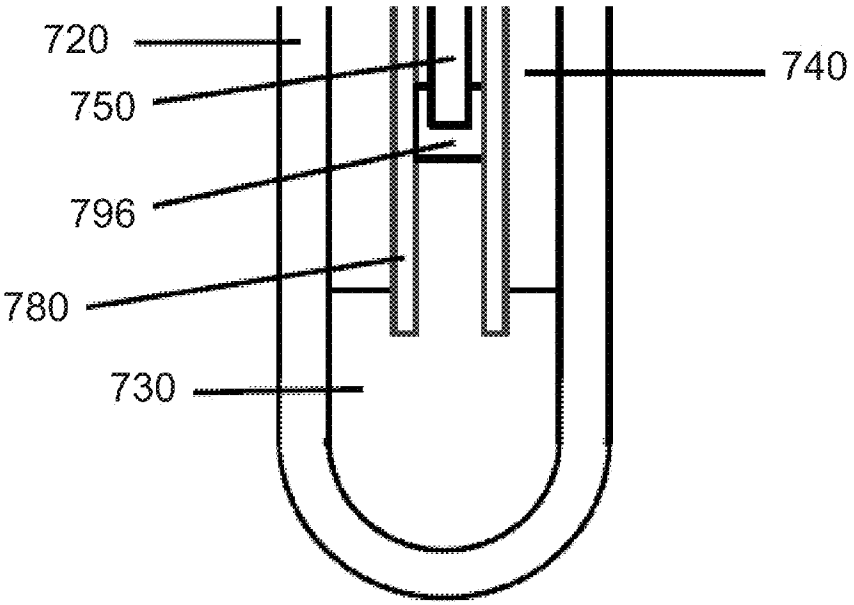
FIG. 7. Another illustrative embodiment of a current collector configuration of the invention wherein the liquid anode extends into the tube.

In another embodiment, the anode material can act as the lower core, contact, first conductor, and seal by forming a solidified plug. Illustratively as shown in FIG. 7, for a liquid silver anode (730), one can draw the liquid silver in the SOM (720) up through a narrow opening in the tube (780), until it solidifies in contact with the upper core (750) to form a solidified anode plug (796). In this embodiment, the liquid and solid silver inside the tube (780) provide electrical conductivity to the upper core (750), and the solid silver blocks oxygen diffusion which would otherwise cause corrosion of the upper core (750).

Figure 8:
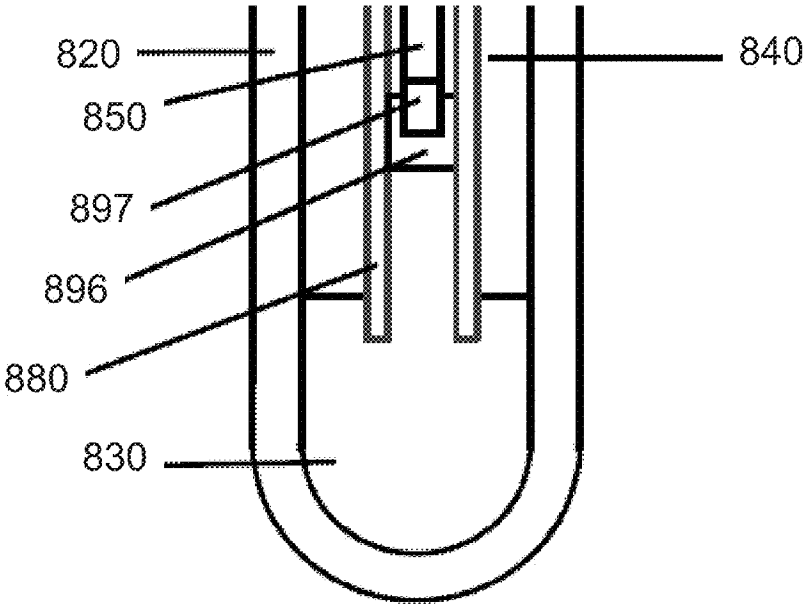
FIG. 8. Another illustrative embodiment of a current collector configuration of the invention comprising a middle and upper core.

In a related embodiment shown in FIG. 8, the SOM (820) contains liquid anode (830) which extends into the tube (880). The extended anode in the tube can contact a "middle core" (897) which is not soluble in the anode, and which is connected to a high-conductivity upper core (850). Thus, in some embodiments, the second conductor further comprises a middle core. In this embodiment, the solidified anode plug (896) is also present. Illustratively, if the anode is silver, the middle core can be nickel, cobalt, chromium or iron, and the upper core copper. The middle core can be attached to the upper core by methods known in the art including, e.g., brazing, soldering, diffusion bonding, a threaded screw connection, or it can be a coating on the upper core, particularly in this illustrative example where the melting point of the copper upper core is above that of the silver anode.

Figure 9:
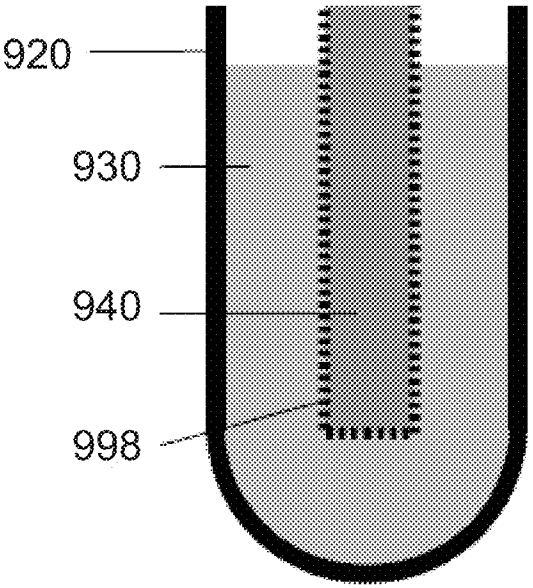
FIG. 9. Another illustrative embodiment of a current collector configuration of the invention comprising an oxide scale forming current collector in a liquid metal anode.

In another embodiment, metals which resist oxidation at high temperature by forming a protective oxide scale layer, such as molybdenum-silicon, nickel-chromium, nickel-aluminum iron-chromium or iron-aluminum alloys, have varying solubility in liquid silver. The less soluble of these scale-forming metals can be used as current collector, and would saturate the silver with its soluble elements, and form an oxide scale both outside and within the area of contact between the liquid silver, as shown in FIG. 9. In this embodiment, the liquid metal anode (930) in the SOM (920) forms an oxide scale. The oxide scale (998) acts as the contact, seal, tube and first conductor, and the metal itself (940) acts as the lower core and possibly upper core as well.

Figure 10:
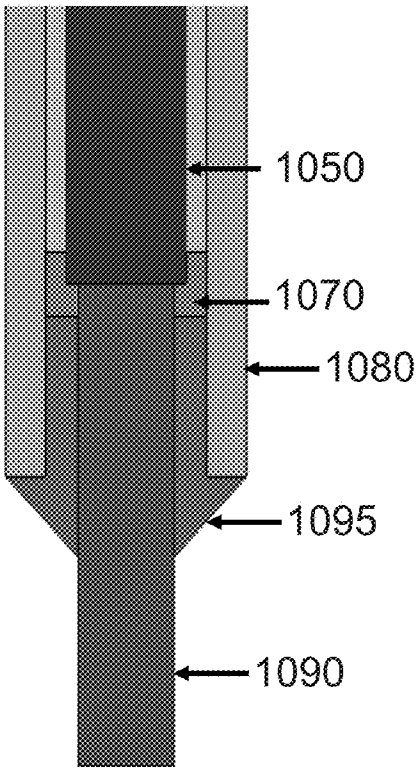
FIG. 10. Another illustrative embodiment of a current collector configuration of the invention.

Yet another embodiment is shown in FIG. 10. In this embodiment, the first conductor (1090) comprising LSM is in contact with the second conductor (1050) comprising an Inconel alloy and a contact (1070) comprising silver. A seal (1095) comprising zirconia paste is disposed at least partially between the first conductor and the tube (1080), which comprised of alumina.

Figure 11:
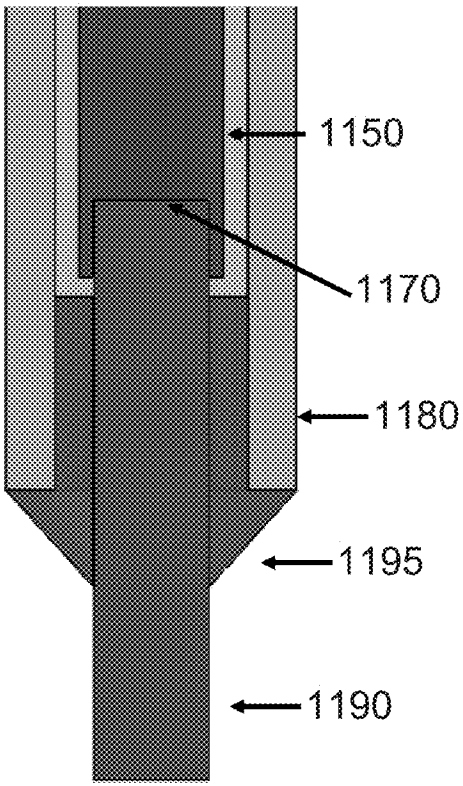
FIG. 11. Another illustrative embodiment of a current collector configuration of the invention.

Still another embodiment is shown in FIG. 11. In this embodiment, the first conductor (1190) comprising LSM is in contact with the second conductor (1150) comprising an Inconel alloy and a contact (1170) comprising platinum paste and nickel mesh is disposed between the first and second conductor. In this embodiment, the end of the first conductor is disposed within an indent or groove in the second conductor. A seal (1195) comprising zirconia paste is disposed at least partially between the first conductor and the tube (1180), which comprised of alumina.

Liquid metal anodes are described, for example, in *J. Electrochemical Society,* 2009, 156(9), B1067-B1077 and *Int. J. Hydrogen Energy* 26 (2011), 152-159; each herein incorporated by reference in its entirety).

In some embodiments, the current collector has a resistance of about 1 ohm or less. In some embodiments, the resistance is about 0.5 ohm or less. In some embodiments, the resistance is about 0.1 ohm or less. In some embodiments, the resistance is about 0.05 ohm or less. In some embodiments, the resistance is about 0.01 ohm or less. In some embodiments, the resistance is about 0.005 ohm or less.

In some embodiments, the processes and apparatuses described herein entail the use of modified SOM processes that enable extraction of metals from metal oxides. Representative embodiments of the SOM apparatus and process may be found, for example, in U.S. Pat. Nos. 5,976,345; 6,299,742; and *Mineral Processing and Extractive Metallurgy* 117 (2):118-122 (June 2008); *JOM Journal of the Minerals, Metals and Materials Society* 59(5):44-49 (May 2007); *Metall. Mater. Trans.* 36B:463-473 (2005); *Scand. J. Metall.* 34(5): 293-301 (2005); and International Patent Application Publication Nos. WO 2007/011669 and WO 2010/126597; each of which hereby incorporated by reference in its entirety.

In some embodiments, methods further comprise collecting the metallic species. Methods of collecting metallic species are known (See, e.g., Krishnan et al, *Metall. Mater. Trans.* 36B:463-473 (2005); Krishnan et al, *Scand. J. Metall.* 34(5): 293-301 (2005); and U.S. Pat. No. 400,664; each herein incorporated by reference in its entirety).

In some embodiments, the molten salt is at a temperature of from about 700° C. to about 2000° C. In some embodiments, the molten salt is at a temperature of from about 700° C. to about 1600° C. In some embodiments, the molten salt is at a temperature of from about 700° C. to about 1300° C. In some embodiments, the molten salt is at a temperature of from about 700° C. to about 1200° C. In some embodiments, the molten salt is at a temperature of from about 1000° C. to about 1300° C. In some embodiments, the molten salt is at a temperature of from about 1000° C. to about 1200° C. In some embodiments, the molten salt is at a temperature of from about 1100° C. to about 1200° C. In some embodiments, the molten salt is at a temperature about 1150° C.

In some embodiments, the molten salt is at least about 90% liquid. In some embodiments, the molten salt is at least about 92% liquid. In some embodiments, the molten salt is at least about 95% liquid. In some embodiments, the molten salt is at least about 98% liquid. In some embodiments, the molten salt is at least about 99% liquid.

It will be recognized that one or more features of any embodiments disclosed herein may be combined and/or rearranged within the scope of the invention to produce further embodiments that are also within the scope of the invention.

Those skilled in the art will recognize, or be able to ascertain using no more than routine experimentation, many equivalents to the specific embodiments of the invention described herein. Such equivalents are also intended to be within the scope of the present invention.

The following examples illustrate the present invention, and are set forth to aid in the understanding of the invention, and should not be construed to limit in any way the scope of the invention as defined in the claims which follow thereafter.

EXAMPLES

Example 1

LSM Current Collector

Ceramic Tube and LSM First Conductor Design

The goal of the ceramic tube and LSM first conductor design is to provide a seal around a conductive metal core to protect it from oxidation, while maintaining electrical conductivity through the first conductor. As described previously, LSM is a good material choice for the first conductor because of its tolerance of a high temperature and high oxygen environment while maintaining relatively high conductivity. The LSM first conductor is ideally dense and substantially non-porous to avoid percolation or diffusion of oxygen through the first conductor. The joint between the LSM first conductor and the ceramic tube is also ideally gas-tight and mechanically stable. Additionally, the current collector is advantageously able to withstand the temperature gradients of hundreds of degrees over the span of a few inches that are present in the experimental set-ups. The ceramic tube materials used in this example were alumina and/or mullite.

A uniaxially pressed and sintered LSM pellet was used as the LSM first conductor. Since the pellets would already be dense and sintered, creating a good seal between the LSM and the ceramic tube was pursued. The LSM powder was prepared for pressing by heating 50 mL of xylene to 50-70° C. and mixing in 1 gram of paraffin wax until dissolved. 50 grams LSM powder (Praxair, Inc.—particle size: 0.5-3.3 micron diameter) was well-mixed in as the temperature was increased to 100° C. for the evaporation of the xylene. After all the xylene was evaporated, the resulting powder was sifted with a 50 micron sieve. Next, the powder was pressed in a hydraulic press using 6 mm diameter powder pellet dies using four tons of force for ten seconds. The resulting 'green' pellets were fired on a zirconia plate using the following schedule and a five degree/minute ramp rate: ramp up to 300° C., hold for two hours, ramp to 700° C., hold for two hours, ramp to 1300° C., hold for three hours, then ramp down to room temperature. Finally, the pellets were abraded with sandpaper (P100 grit) to remove surface contaminants and encourage bonding with adhesives. At room temperature, simple measurements across the ends of the pellets using a multimeter and sharp pointed steel probes showed that the resistance of the pellets ranged from 20-40 ohms.

A method was devised for preserving surface conductivity of the LSM pellet during fabrication and application of ceramic adhesives. A drop of melted beeswax was applied to each side of the pellet before inserting the pellet into the tip of the current collector. The beeswax prevents the ceramic adhesive from blocking the current path through the LSM pellet and burns off during operation.

Current collectors were made using 569 adhesive (Aremco Products, Inc.) mixed with 10 wt % 569-T thinner (Aremco Products, Inc.) and LSM pellets of 6 mm diameter. This experiment used a "double-sheath" design, with a ¼" OD tube for the majority of the current collector, with a short ½" OD tube at the end of the current collector that contained the LSM pellet first conductor. An adhesive mixture was added to seal the gap between the pellet and the tube. After fabrication and curing of the adhesive, each current collector was inspected visually for build quality. Silver granules were inserted inside each current collector and the current collectors were tested using the immersed the assembled current collector in an alumina crucible filled with molten silver. A fresh nichrome wire of negligible resistance was also immersed in the molten silver and used as the opposite current lead in EIS sweeps through the current collector. This experiment was done at atmosphere rather than a pure oxygen environment. Long ⅛" diameter Invar rod was inserted from the second end of the current collector to use as the second conductor core, and sealed using standard Ultra-Torr vacuum fittings (Swagelok Company).

The seal for the LSM pellet was achieved through the use of a thin alumina ring (¼" outer diameter, ~1-2 mm thickness) in conjunction with the ceramic adhesive. The alumina rings were cut from the same ¼" alumina tubes that are used for the inner tube of the current collector. The outer diameter tube was secured to the inner diameter tube by using 503 adhesive (Aremco Products, Inc.) and cured.

The LSM pellet was prepared with the beeswax protectant and the 569/569-T adhesive mixture was used to seal the LSM pellet inside the current collector by application using a small spatula. After allowing the current collector to cure in air at room temperature for two hours, an alumina ring was attached on top of the LSM pellet using 503 alumina adhesive (Aremco Products, Inc.).

Figure 12:
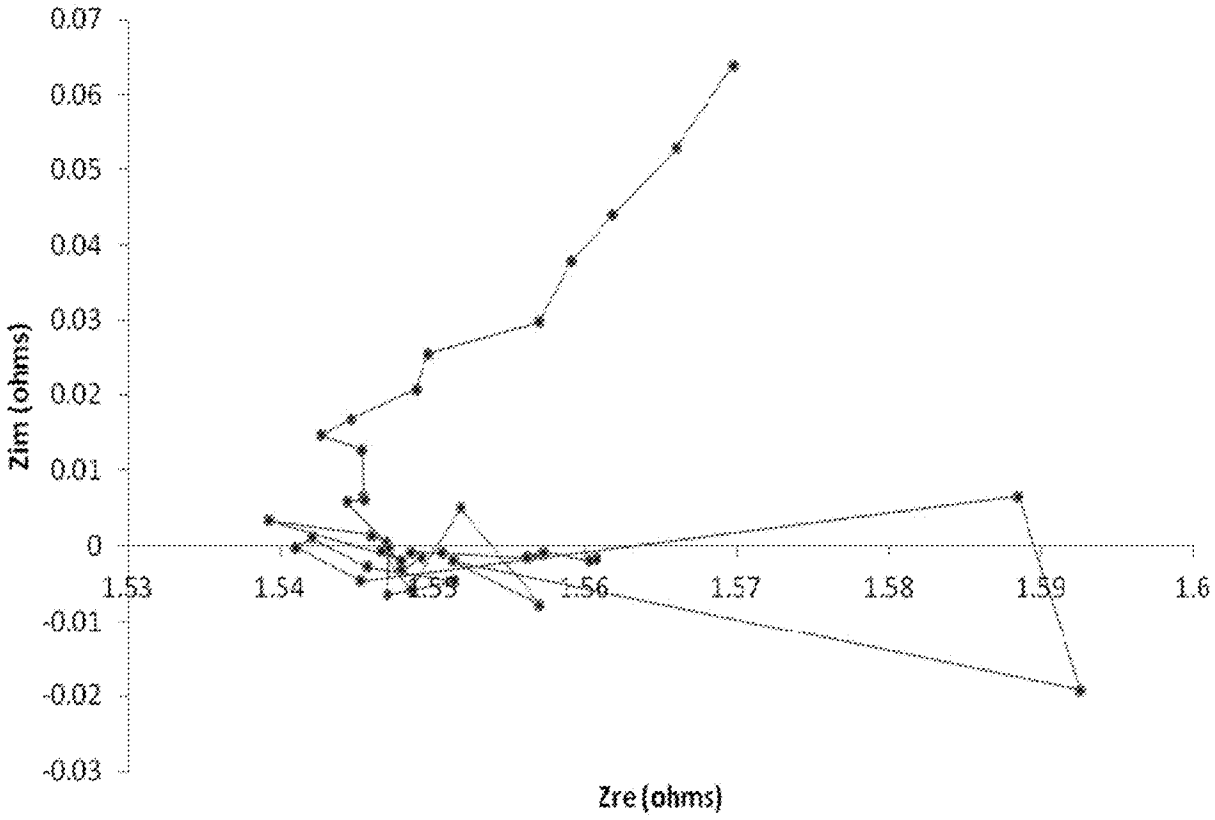
FIG. 12. Results of an initial electrical impedance spectroscopy (EIS) sweep on a current collector embodiment of the invention.

Testing of this current collector showed that the seal did not leak, as indicated by minimal oxidation of the core material. Resistance measurements of the current collector in a molten silver bath matched predicted values of a sealed current collector with no shorting through a silver leakage. The resistance across the current collector was approximately 1.5 ohms at initial EIS sweep (FIG. 12). After 5 hours, the resistance increased to 2.3 ohms. After the experiment was performed, the current collector was removed from the molten silver bath and showed no signs of silver leaking out of the current collector. These measurements indicated that the LSM pellet was conducting well.

Example 2

Production of Magnesium and Oxygen by SOM Electrolysis with an Inert Current Collector and Liquid Silver Anode An inert current collector was used as shown in FIG. 13. A liquid silver contact (1370) is disposed between a LSM first conductor (1390) and an inconel alloy 601 second conductor (1350). Alumina paste (1395) is disposed at least partially between the LSM first conductor and the alumina tube (1380). In this example, LSM powder (1399) is also added as a seal between the alumina paste and the liquid silver contact, and sinters at the operating temperature of the cell.

Figure 14:
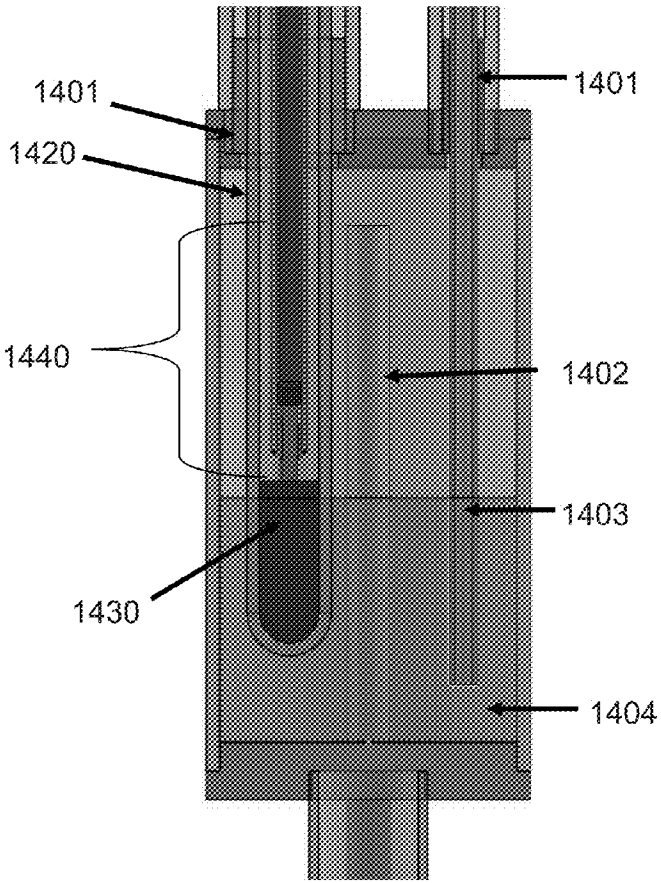
FIG. 14. Another illustrative embodiment of a current collector configuration of the invention disposed in a SOM and a crucible to generate an electrolytic cell.

The current collector (1440) was disposed in a SOM (1420) containing liquid silver (1430) as shown in FIG. 14. The SOM was then disposed in a crucible equipped with a venting tube (1402), stirring tube (1403) and containing flux (1404). Alumina spacers (1401) were also added. Argon flow rate at the stirring tube was 125 cc/min, 180 cc/min at the stirring tube annulus and at the SOM annulus, and 30 cc/min at the current collector. Argon served three purposes: it diluted the magnesium vapor product to prevent its reaction with the SOM tube, it stirred the molten salt, and it provided flow down the SOM annulus to prevent magnesium diffusion upward where it could condense or react with the SOM. The flux composition was (45 wt. % $MgF_2$-55 wt. % $CaF_2$)-10 wt. % MgO-2 wt. % $YF_3$ (470 grams total), and hot zone temperature was 1150° C. The LSM bar dimensions were 0.661 length×0.119 width× 0.139 height (all expressed in inches).

Figure 15:
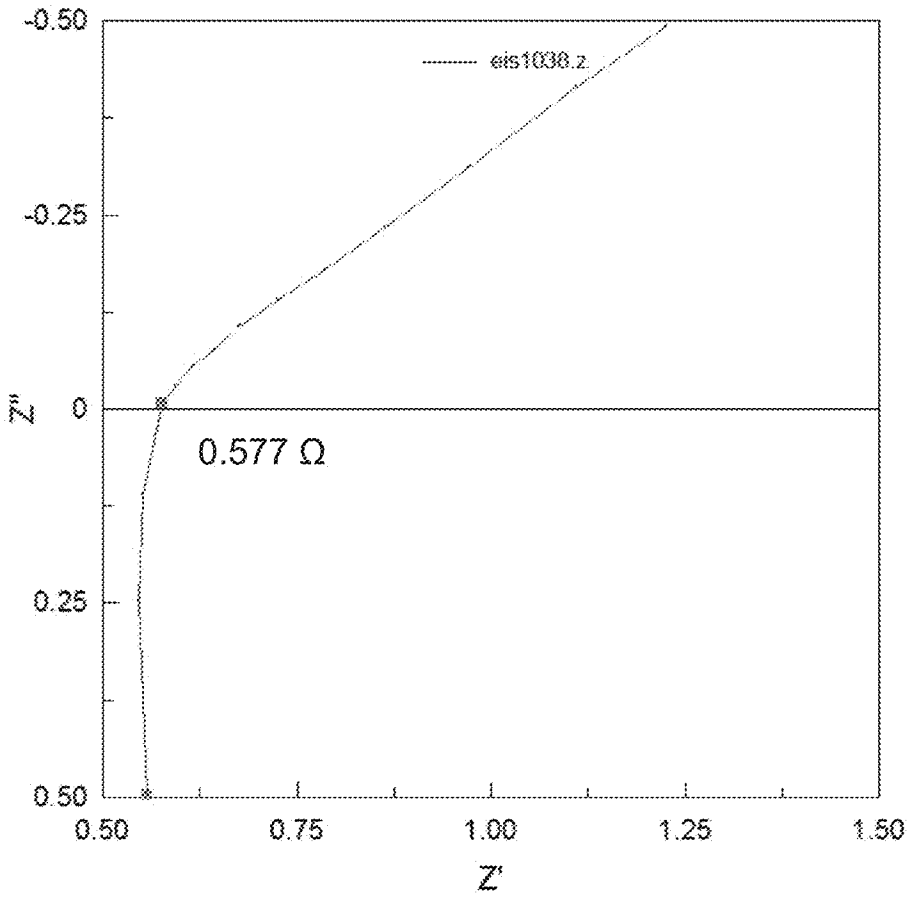
FIG. 15. Results of an initial electrochemical impedance spectroscopy (EIS) sweep on a current collector embodiment of the invention disposed in a SOM and a crucible to generate an electrolytic cell.
Figure 16:
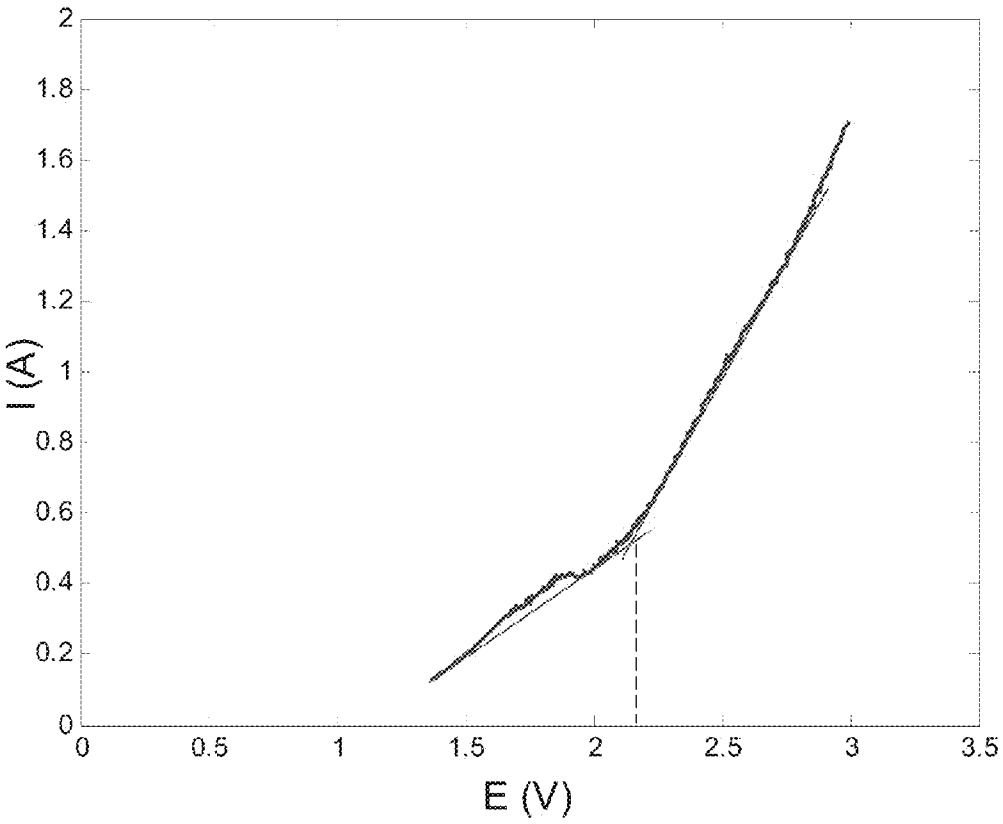
FIG. 16. Results of a potentiodynamic scan before electrolysis on a current collector embodiment of the invention disposed in a SOM and a crucible to generate an electrolytic cell.

Electrochemical impedance spectroscopy (EIS) results before electrolysis are shown in FIG. 15, where the anode is liquid silver and the cathode is the reaction crucible wall. Theoretical resistance of the LSM bar is 0.07 ohms at 1150° C., which is very low, and indicates excellent electrical contact between the Inconel core and LSM first conductor. Potentiodynamic scan at 5 mV/s before electrolysis is shown at FIG. 16, where the cathode is the stirring tube and the anode is liquid silver. The theoretical dissociation potential for the reaction $2MgO=2Mg+O_2(g)$ is 2.3 V at 1150° C. The experimental measurement is consistent with the theoretical value, indicating that the anode is producing oxygen, and that the Inconel core did not oxidize.

Figure 17:
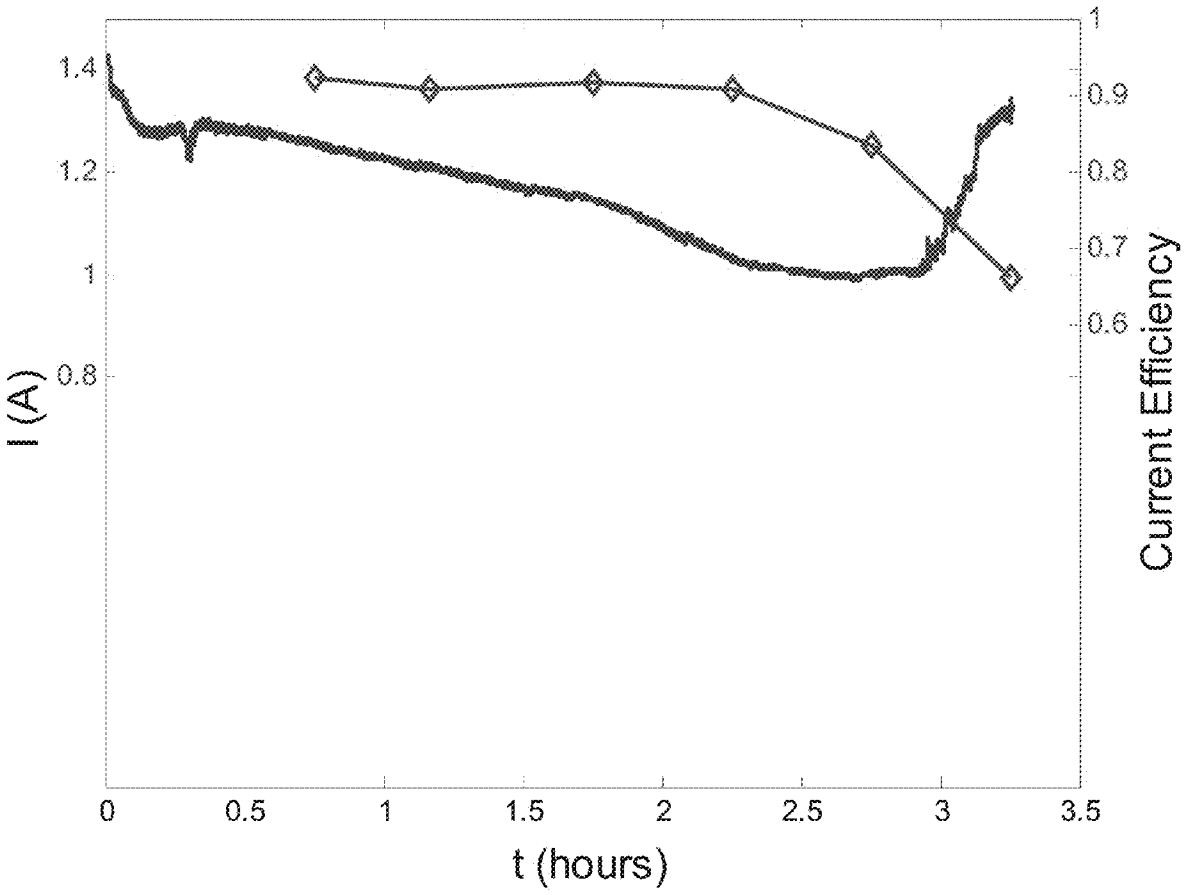
FIG. 17. A first electrolysis and current efficiency (shown in diamonds) of a current collector embodiment of the invention disposed in a SOM and a crucible to generate an electrolytic cell.
Figure 18:
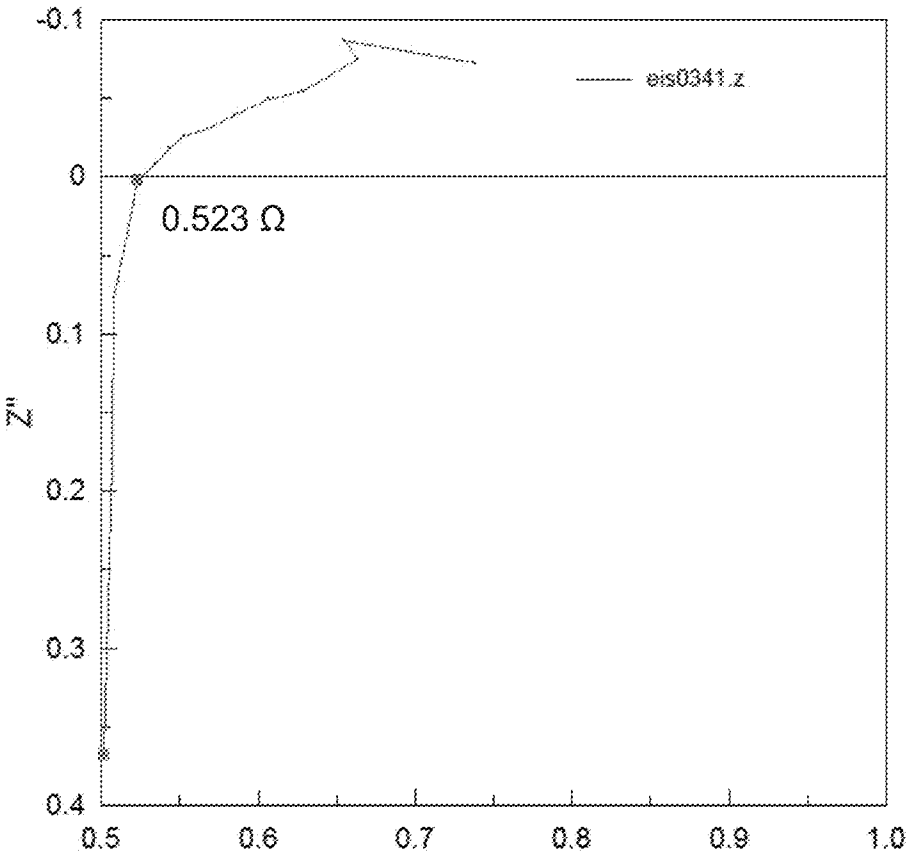
FIG. 18. Results of an EIS sweep after the first electrolysis on a current collector embodiment of the invention disposed in a SOM and a crucible to generate an electrolytic cell.
Figure 19:
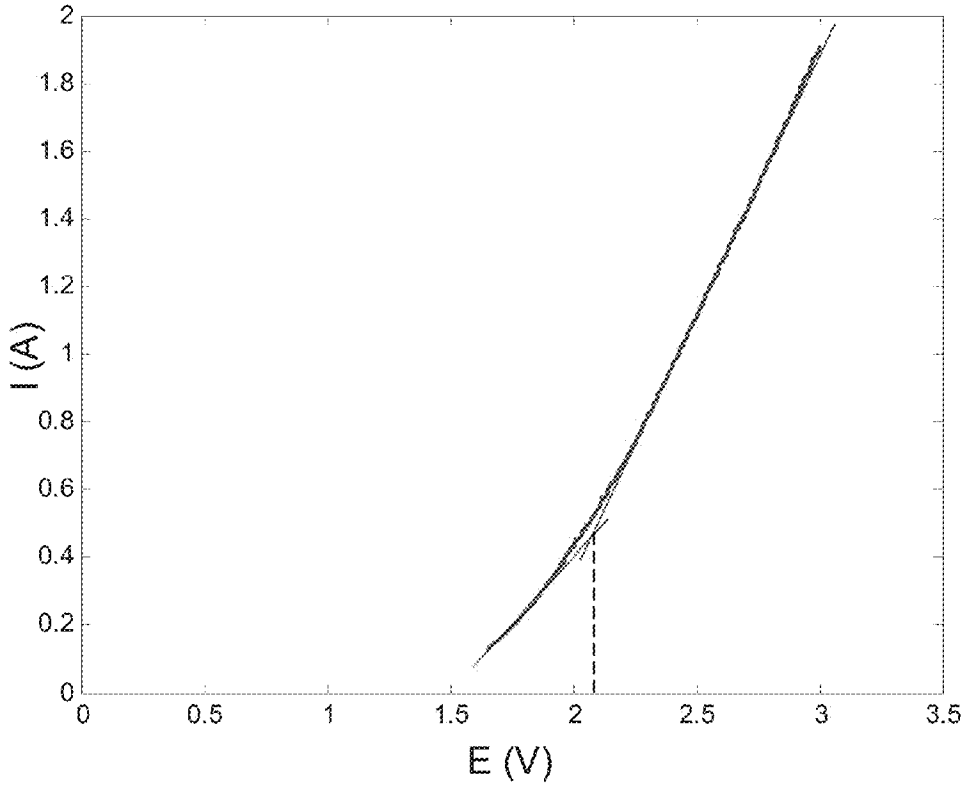
FIG. 19. Results of a potentiodynamic scan of the first electrolysis on a current collector embodiment of the invention disposed in a SOM and a crucible to generate an electrolytic cell.

Electrolysis at 2.75 V and current efficiency over 3.5 hours are shown at FIG. 17. Electrochemical impedance spectroscopy (EIS) after the first electrolysis is shown at FIG. 18. Here, the cathode is the reaction crucible wall and impedance goes lower. Dissolution of magnesium increases electronic conductivity in the flux. Potentiodynamic scan at 5 mV/s is shown at FIG. 19, where the cathode is the stirring tube and the anode is liquid silver. The measured dissociation potential of 2.1 V is again roughly consistent with the theoretical value, indicating that the anode continued to produce oxygen, and that the Inconel core did not oxidize.

Figure 20:
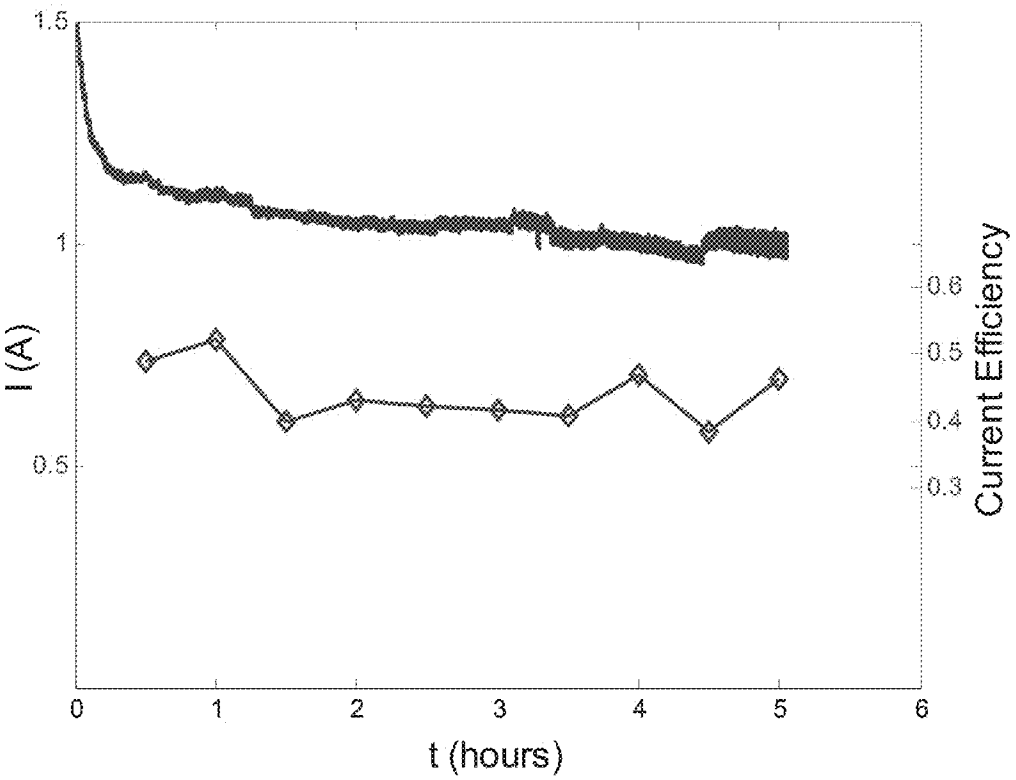
FIG. 20. A second electrolysis and current efficiency (shown in diamonds) of a current collector embodiment of the invention disposed in a SOM and a crucible to generate an electrolytic cell.
Figure 21A:
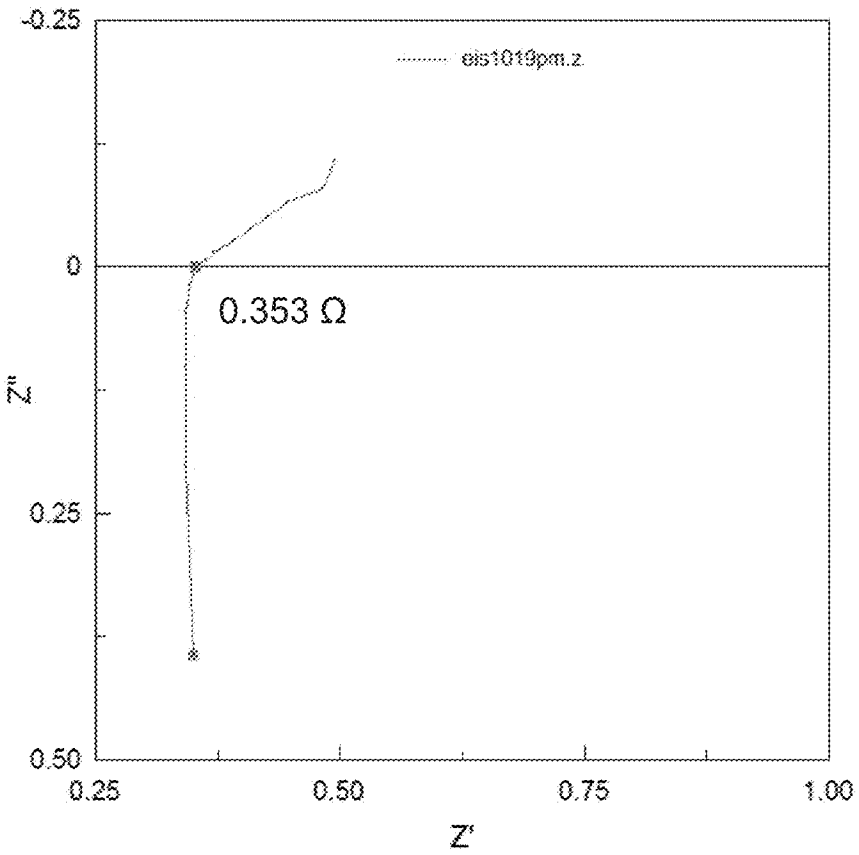
FIG. 21(A). Results of an EIS sweep after the second electrolysis on a current collector embodiment of the invention disposed in a SOM and a crucible to generate an electrolytic cell.
Figure 21B:
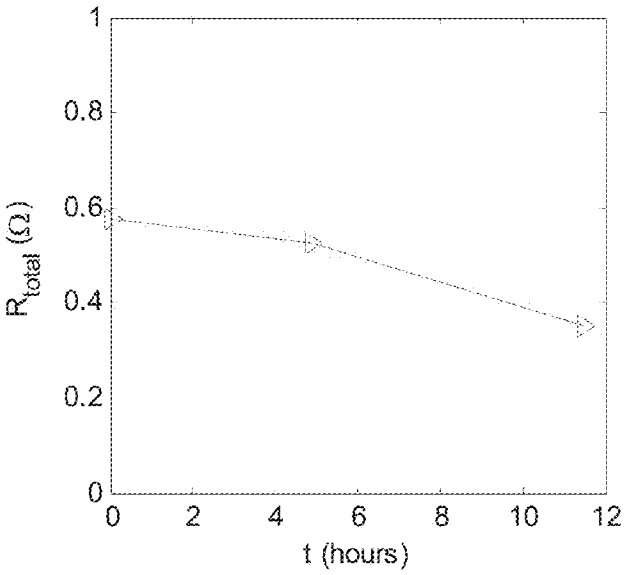
FIG. 21 (B). Real impedance measured by EIS at various times during the SOM electrolysis experiment.

A second electrolysis at 2.75 V and current efficiency over 6 hours are shown at FIG. 20. Electrochemical impedance spectroscopy (EIS) after the second electrolysis is shown at FIG. 21A, and shows a real impedance of 0.353 ohms. Here, the cathode is the reaction crucible wall and impedance goes even lower (FIG. 21B).). The lower impedance is a good indication that the current collector resistance remains low.

Oxygen partial pressure in the anode exit gas was monitored and is indicated in Table 1.

TABLE 1

| Oxygen partial pressure in anode exit gas. | | | | | | | | | | |
|---|---|---|---|---|---|---|---|---|---|---|
| | During 1st electrolysis | | | | | During 2nd electrolysis | | | | |
| | T (C.) | | | | | | | | | |
| | 692 | 701 | 709 | 715 | 748 | 712 | 702 | 701 | 706 | 712 |
| E (V) | 0.0224 | 0.0231 | 0.0238 | 0.0247 | 0.0245 | 0.0242 | 0.0236 | 0.0227 | 0.0229 | 0.0235 |
| P $O_2$ (atm) | 0.617 | 0.632 | 0.647 | 0.671 | 0.640 | 0.657 | 0.646 | 0.619 | 0.622 | 0.636 |

Figure 22:
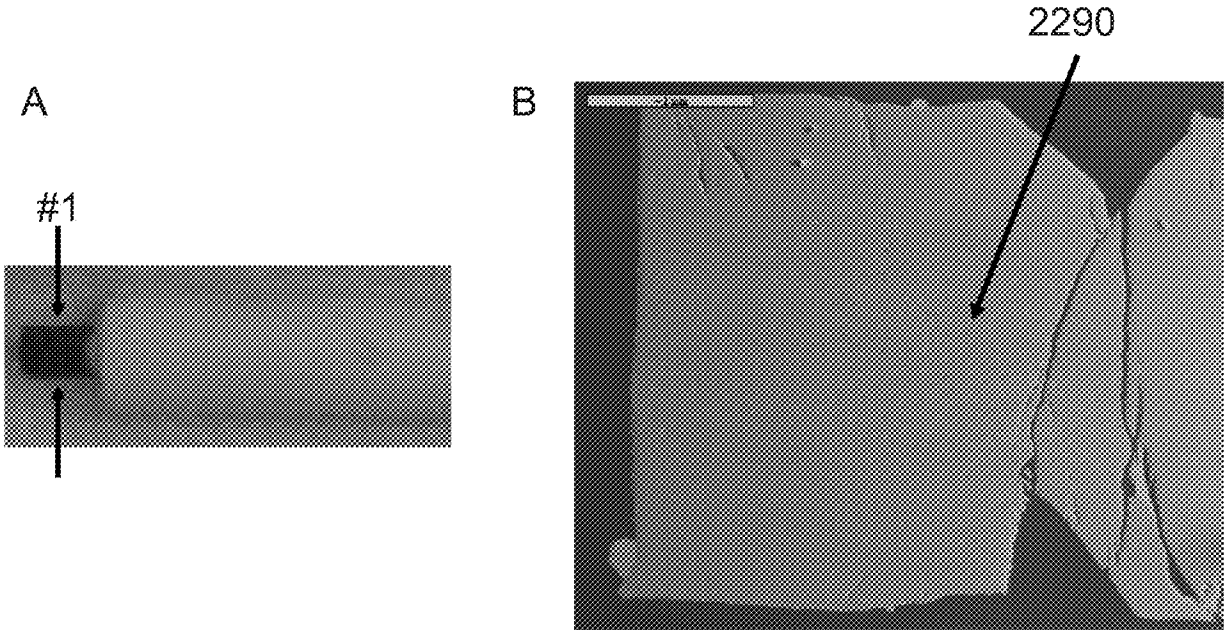
FIG. 22 (A). A first cross section of a current collector embodiment of the invention.

FIG. 22 shows characterization of the inert current collector via a SEM image of a cross section (1) of the LSM bar (FIG. 22A). The image (FIG. 22B) shows the LSM (2290) is intact and not eroding when in contact with the liquid silver. LSM is a stable conductor.

Figures 23A, 23B:
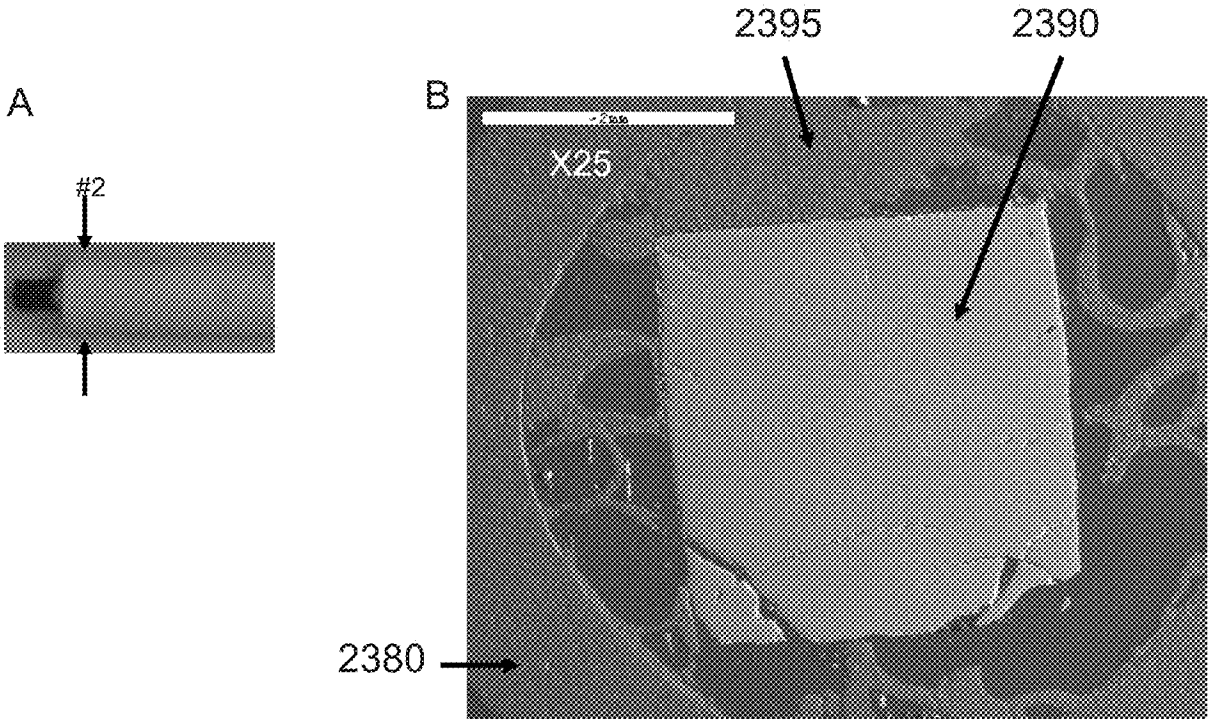
FIG. 23 (A). A second cross section of a current collector embodiment of the invention.
Figure 23C:
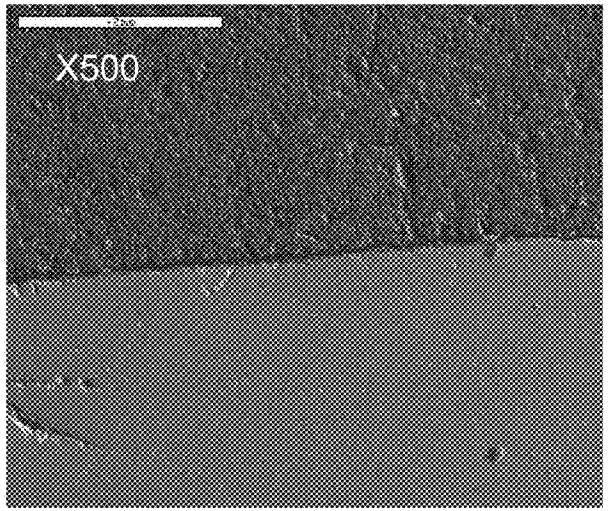
Figure 23D:
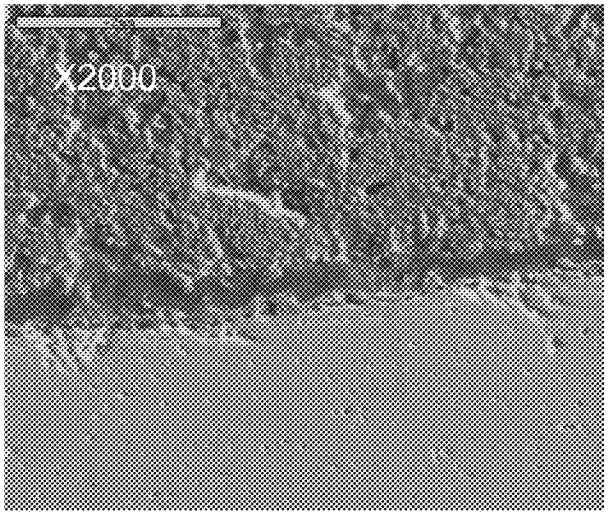

FIG. 23 shows characterization of the inert current collector via a SEM image of a cross section (2) (FIG. 23A). The image at 25× magnification shows some reaction layer between the LSM (2390) and alumina paste (2395) at high temperature to generate a solid state product that aids as a seal (2295) (FIG. 23B). This is better seen at higher magnification (500×) (FIG. 23C) and (2000×) (FIG. 23D). Silver is not observed in these figures.

Figure 24A:
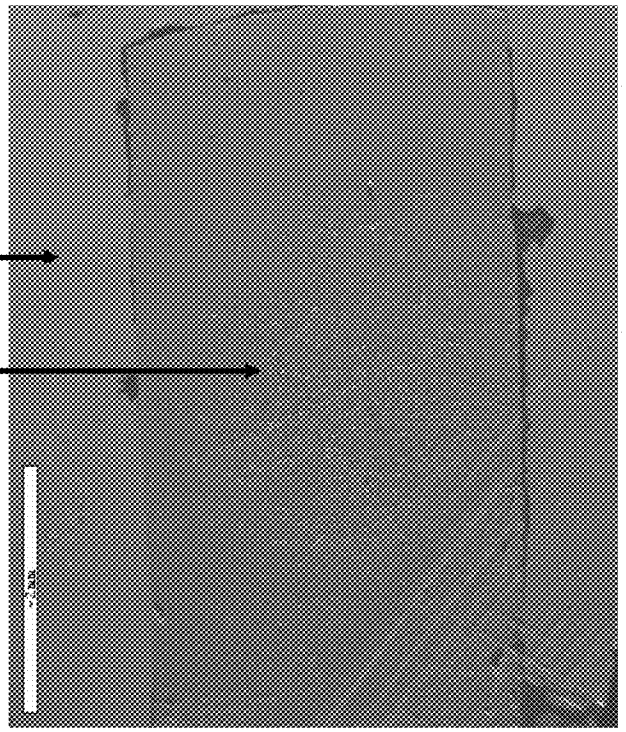
FIG. 24 (A). A third cross section of a current collector embodiment of the invention.
Figure 24:
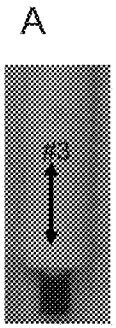
Figure 24C:
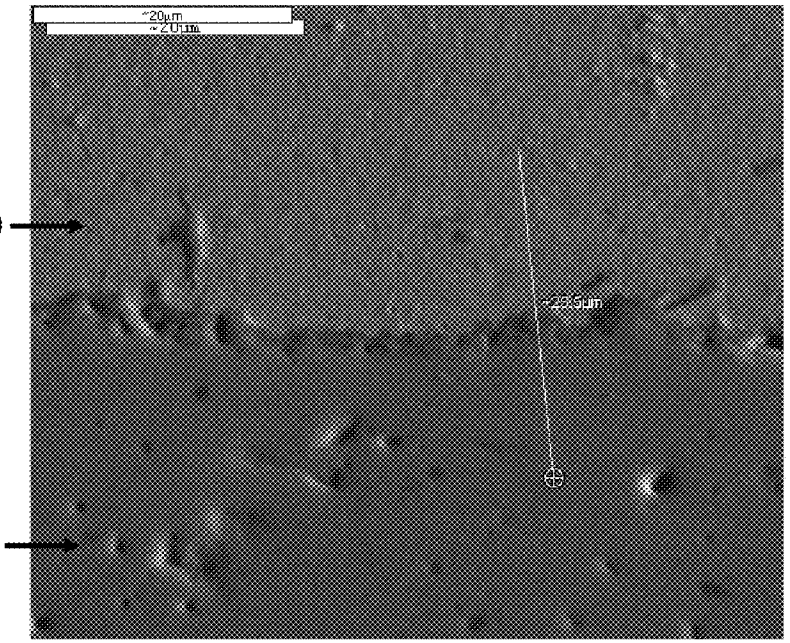
Figure 24:
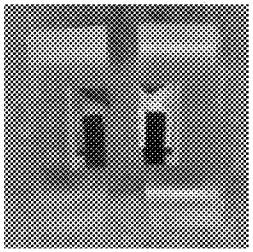
Figure 24E:
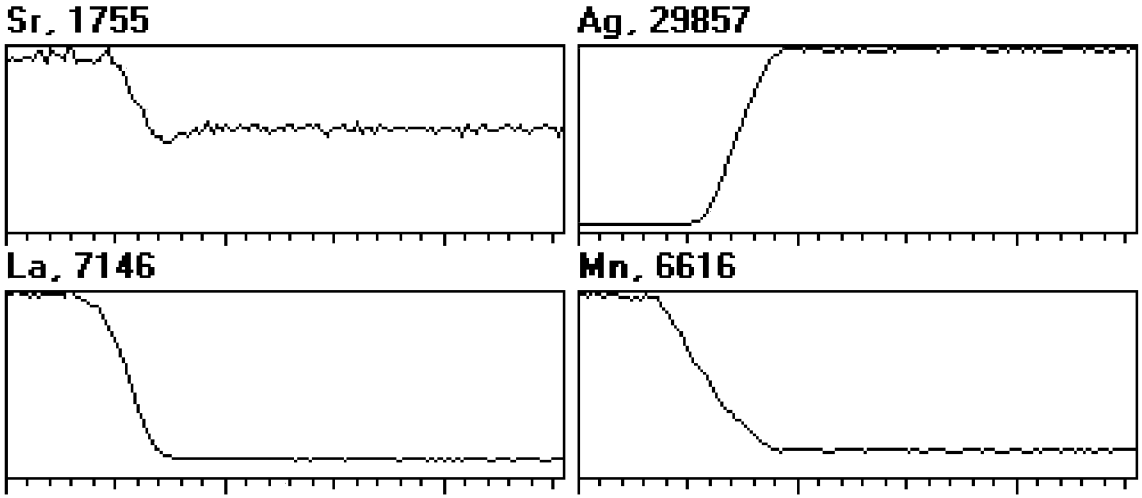

FIG. 24 shows characterization of the inert current collector via a SEM image of a cross section (3) (FIG. 24A). FIG. 24 B shows the cross-section of the current collector at low magnification, with the LSM first conductor 2490 and surrounding silver contact 2470. FIG. 24 C shows the LSM first conductor and surrounding silver contact. FIG. 24 D shows the interface between the silver contact 2470 and LSM first conductor 2490 at higher magnification, and a line along which composition was measured by energy-dispersive spectroscopy. FIG. 24E shows the relative concentrations of lanthanum (La), strontium (St), manganese (Mn) and silver (Ag) across that interface, and indicates negligible interdiffusion or reaction between the LSM and silver over the course of the experiment.

* * *

As will be apparent to one of ordinary skill in the art from a reading of this disclosure, further embodiments of the present invention can be presented in forms other than those specifically disclosed above. The particular embodiments described above are, therefore, to be considered as illustrative and not restrictive. Those skilled in the art will recognize, or be able to ascertain, using no more than routine experimentation, numerous equivalents to the specific embodiments described herein. Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways within the scope and spirit of the invention. The scope of the invention is as set forth in the appended claims and equivalents thereof, rather than being limited to the examples contained in the foregoing description.

What is claimed is:

1. An apparatus comprising:

(a) a tube having a first end and a second end, the tube comprising a material stable in an environment with oxygen partial pressure above 0.1 atm and robust in thermal gradients of at least 10° C./cm;

(b) a first electronic conductor disposed at the first end of the tube; and (c) a second electronic conductor for electrically connecting the first electronic conductor to the current source of an electrolytic cell, the second conductor being at least partially disposed within the tube;

wherein the tube and the first conductor form a gas tight sheath between the second conductor and an oxygen environment outside the tube.

2. The apparatus of claim 1, wherein the second conductor comprises an upper core and a lower core.

3. The apparatus of claim 2, wherein the upper core comprises a metal or a metal oxide.

4. The apparatus of claim 2, wherein the lower core has a melting point above the operating temperature of the electrolytic cell.

5. The apparatus of claim 2, wherein at least one of the upper core and lower core comprise at least one of copper, nickel, cobalt, iron, chromium, manganese, molybdenum, tungsten, niobium, iridium, and alloys thereof.

6. The apparatus of claim 2, wherein the upper core and lower core are connected by at least one of a press fit, solid state diffusion bond, and friction weld.

7. The apparatus of claim 1, further comprising a contact in electronic communication with the first conductor and the second conductor.

8. The apparatus of claim 7, wherein the contact has a melting or solidus point below the operating temperature of the electrolytic cell and in a liquid or semi-solid state at the operating temperature of the electrolytic cell, and a resistance below 0.1 ohm.

9. The apparatus of claim 7, wherein the contact comprises at least one of silver, copper, tin, bismuth, lead, antimony, zinc, gallium, indium, cadmium, and alloys thereof.

10. The apparatus of claim 1, further comprising a seal disposed between the tube and the first conductor, wherein the seal has a liquidus point or glass transition above the operating temperature of the electrolytic cell.

11. The apparatus of claim 10, wherein the seal is stable in a liquid metal anode or electrolyte.

12. The apparatus of claim 10, wherein the seal comprises at least one of glass that softens around about 1200° C. to about 1300° C., powder that softens and/or sinters at or above about 1200° C., and mixtures thereof.

13. The apparatus of claim 10, wherein the seal comprises at least one of alumina, zirconia, magnesia and other metal oxides.

14. The apparatus of claim 10, further comprising another material disposed between the seal and the contact.

15. The apparatus of claim 14 where the another material is lanthanum strontium manganite (LSM) or another material suitable for the first conductor, wherein the first conductor comprises an A-site deficient acceptor-doped lanthanum ferrite or lanthanum cobaltite, wherein A includes dopants selected from Ca, Ce, Pr, Nd, and Gd in the La site; and Ni, Cr, Mg, Al, and Mn in the Fe or Co site.

16. The apparatus of claim 1, wherein the first conductor comprises a material having solubility less than about 1% by weight in a liquid metal anode or electrolyte and is stable in an oxygen rich environment.

17. The apparatus of claim 1, wherein the first conductor comprises an A-site deficient acceptor-doped lanthanum ferrite or lanthanum cobaltite, wherein A includes dopants selected from Ca, Ce, Pr, Nd, and Gd in the La site; and Ni, Cr, Mg, Al, and Mn in the Fe or Co site.

18. The apparatus of claim 1, wherein the tube comprises at least one of alumina, mullite, quartz glass, fused silica, and combinations thereof.

19. The apparatus of claim 1, wherein the first conductor comprises an P-type oxide.

20. The apparatus of claim 19, wherein the first conductor comprises Sr-doped $LaMnO_3$, (La, Sr)(Co, Fe)$O_3$, Sr-doped $LaCoO_3$, Sr-doped $LaFeO_3$, Sr-doped $LaVO_3$, Sr-doped $La_2NiO_4$, Sr-doped $PrMnO_3$, Ca-doped $LaMnO_3$, Ca-doped $YMnO_3$, (Gd, Sr)(Co, Mn)$O_3$, (Gd, Ca)(Co, Mn)$O_3$, (La, Sr)(Cr, Mn)$O_3$, or M-doped $LaNiO_3$, wherein M is Al, Cr, Mn, Fe, Co, or Ga.

21. The apparatus of claim 1, wherein the first conductor comprises iridium or strontium-doped lanthanum manganite.

22. The apparatus of claim 1, wherein the first conductor comprises iridium.

23. The apparatus of claim 1, wherein the first conductor comprises strontium-doped lanthanum manganite.

* * * * *